US005574545A

United States Patent [19]

Hosoi et al.

[11] Patent Number: 5,574,545

[45] Date of Patent: Nov. 12, 1996

[54] METHOD FOR TRANSFERRING TONER FROM DEVELOPER CARRYING MEMBER TO IMAGE BEARING MEMBER USING CHAINS OF MAGNETIC PARTICLES FORMED ON DEVELOPER CARRYING MEMBER AND CONTACTING IMAGE BEARING MEMBER, AND ALTERNATING ELECTRIC FIELD

[75] Inventors: Atsushi Hosoi, Tokyo; Hatsuo Tajima, Matsudo; Takashi Saito, Ichikawa; Norihisa Hoshika, Kawasaki; Hiroshi Tajika, Yokohama; Masaaki Yamaji, Tokyo, all of Japan

[73] Assignee: Canon Kabushiki Kaisha, Tokyo, Japan

[21] Appl. No.: 455,716

[22] Filed: May 22, 1995

Related U.S. Application Data

[63] Continuation of Ser. No. 41,360, Apr. 1, 1993, abandoned, which is a continuation of Ser. No. 490,712, Mar. 8, 1990, abandoned, which is a division of Ser. No. 257,164, Oct. 13, 1988, Pat. No. 4,933,254, which is a continuation of Ser. No. 163,149, Feb. 25, 1988, abandoned, which is a continuation of Ser. No. 906,080, Sep. 10, 1986, abandoned.

[30] Foreign Application Priority Data

| | | | |
|---|---|---|---|
| Sep. 2, 1985 | [JP] | Japan | 60-207013 |
| Sep. 17, 1985 | [JP] | Japan | 60-204605 |
| Sep. 30, 1985 | [JP] | Japan | 60-217556 |
| Sep. 30, 1985 | [JP] | Japan | 60-217559 |
| Nov. 11, 1985 | [JP] | Japan | 60-252316 |
| Nov. 11, 1985 | [JP] | Japan | 60-252317 |
| Nov. 11, 1985 | [JP] | Japan | 60-252319 |
| Nov. 11, 1985 | [JP] | Japan | 60-252320 |

[51] Int. Cl.[6] ..... G03G 15/09; G03G 9/14

[52] U.S. Cl. ..... 399/270

[58] Field of Search ..... 355/245, 251, 355/253, 259; 118/657, 658

[56] References Cited

U.S. PATENT DOCUMENTS

| | | | |
|---|---|---|---|
| 4,391,512 | 7/1983 | Nakamura et al. | 118/657 X |
| 4,391,891 | 7/1983 | Tamura et al. | 118/657 X |
| 4,425,373 | 1/1984 | Hosono et al. | 118/657 X |
| 4,517,274 | 5/1985 | Honda et al. | 118/657 X |
| 4,540,645 | 9/1985 | Honda et al. | 118/658 X |
| 4,592,987 | 6/1986 | Mitsuhashi et al. | 118/658 |
| 4,610,531 | 9/1986 | Hayashi et al. | 118/657 X |
| 4,653,427 | 3/1987 | Hosaka et al. | 118/658 |
| 4,672,017 | 6/1987 | Kamezaki | 118/658 X |
| 4,686,934 | 8/1987 | Kohyama | 118/658 X |
| 4,933,254 | 6/1990 | Hosoi et al. | 355/251 X |
| 5,001,517 | 3/1991 | Hosaka et al. | 355/251 X |

FOREIGN PATENT DOCUMENTS 59-67565 4/1984 Japan .

*Primary Examiner*—Fred L. Braun

*Attorney, Agent, or Firm*—Fitzpatrick, Cella, Harper & Scinto

[57] ABSTRACT

In a developing method, a layer of electrically charged toner particles is formed on a surface of a developer carrying member, and magnetic particles which retain on their surfaces electrically charged toner particles are dispersed on the surface of the developing carrying member. The toner particles and magnetic particles are carried on the developing carrying member to a developing position where a surface of an electrostatic latent image bearing member for bearing an electrostatic latent image is opposed with a clearance to the surface of the developer carrying member. An alternating electric field is formed at the developing position against the electrostatic image and chains of magnetic particles are formed by stationary magnetic field generating apparatus disposed behind the developer carrying member. The latent electrostatic latent image is developed by the charge toner particles on the surface of the developer carrying member and on the surface of the magnetic particles in the clearance under the alternating electric field and the stationary magnetic field.

8 Claims, 6 Drawing Sheets

METHOD FOR TRANSFERRING TONER FROM DEVELOPER CARRYING MEMBER TO IMAGE BEARING MEMBER USING CHAINS OF MAGNETIC PARTICLES FORMED ON DEVELOPER CARRYING MEMBER AND CONTACTING IMAGE BEARING MEMBER, AND ALTERNATING ELECTRIC FIELD

This application is a continuation of application Ser. No. 08/041,360 filed Apr. 1, 1993, now abandoned which is continuation of 07/490,712 filed Mar. 8, 1990; now abandoned which is a division of 07/257,164 filed Oct. 13, 1988 (now U.S. Pat. No. 4,933,254); which is a continuation of 07/163,149 filed Feb. 25, 1988, now abandoned which is a continuation of 06/906,080 filed Sep. 10, 1986, now abandoned.

FIELD OF THE INVENTION AND RELATED ART

The present invention relates to a developing method and a developing apparatus embodying the method, wherein a latent image is developed by two component developer containing magnetic particles and toner particles mixed together.

A developing system using one component magnetic toner and a developing system using two component developer, are known. With respect to each of the developing systems, it is also known that the development effect can be enhanced by applying an alternating electric field at the developing station, as disclosed, for example, U.S. Pat. Nos. 4,395,476; 4,425,373; 4,292,387; 4,548,489; 4,579,082; and 4,563,978, all of which have been assigned to the assignee of the present application.

In the developing system disclosed in the U.S. Pat. Nos. 4,395,476; 4,425,373; and 4,292,387, a thin layer of the developer having such a thickness that the developer does not contact the latent image, is formed on a developer carrying member, which will hereinafter be called "sleeve", and then, the developer in the form of a thin layer is brought close to the latent image, where an electric field is formed between the latent image and the developer layer. Since this system uses the one component magnetic toner, it is preferable to employ a developing magnetic pole and to move the sleeve and the latent image bearing member, which hereinafter will be called "drum", at the same peripheral speed in the same direction. This system is found to be very useful since the image reproducibility is good, since the development efficiency (the ratio of the toner to be consumed for the developing action to the toner present at the developing position) is high, and also since the size of the developing device can be reduced.

However, the developer particle contains a relatively large amount of magnetic material, and therefore, it is not suitable for the image formation in non-black colors, e.g., red, blue or the like because those color are not bright enough due to the presence of the magnetic material which is usually black in color. In addition, the image formed with the one component magnetic developer is not strongly fixed on a recording member such as paper by fixing means. Practically, those problems are not very significant. However, from the standpoint of enhancing the quality of the image, they should be solved.

As a developing system wherein those problems have been solved, the U.S. Pat. Nos. 4,548,489; 4,579,082; and 4,563,978 have proposed a system wherein two component developer containing non-magnetic toner particles and magnetic particles are accommodated in a developer container. A thin layer comprising only the non-magnetic toner particles is formed on a developer carrying sleeve. The thin layer of the non-magnetic toner particles is opposed to a latent image to be developed, where an alternating electric field is formed between the latent image and the sleeve. This system does not involve the above described problems arising from the magnetic material, because at the developing position, one-component developer is used. However, this system has problems in that the image density of the developed image is relatively low as well as a negative property (wherein the image density decreases with increase of the latent image potential) which will be described in detail hereinafter.

On the other hand, a developing system wherein two component developer is brought to the developing position, is disclosed in Japanese Laid-Open Patent Application No. 93841/1978, for example. In this system, a large amount of magnetic brush constituted by magnetic particles is supplied to the developing position, that only the toner particles which exist adjacent the free ends of the magnetic brush participate in the actual developing action. In order to increase the image density by causing a large amount of the magnetic brush (not less than 5 mm) to contact the drum, the rotational speed of the sleeve is increased so as to be not less than three times the drum rotational speed. Additionally, since the percentage of the toner particles consumable for the development in the magnetic brush is small, development efficiency is low. Furthermore, the developed image has a trace of brush strokes. In order for the sleeve to convey the large amount of the magnetic brush, high driving power is required. This is not advantageous since the uniform rotation can be impeded as well as the wasteful power consumption.

As for a developing system having a high development efficiency in the magnetic brush development using two component developer, a proposal has been made in Japanese Laid-Open Patent Application 32060/1980 filed by the assignee of the present application. In this system, the magnetic brush is formed at the developing position in an alternating electric field, by which the non-magnetic toner particles contained in the magnetic brush as well as those particles adjacent the free ends of the magnetic brush are usable for the developing action, thus increasing the development efficiency. It has been found that good images can be formed by this system.

However, this system which forms a large amount of the magnetic brush at the developing station, involves a problem that when the developer toner content changes, the change directly influences the image quality obtained thereby. Therefore, it is inevitably required that the toner content be strictly controlled in the developer container. It is practically impossible to omit the toner content control means. As will be understood, the development efficiency is even better than the conventional systems described hereinbefore. However, wasteful magnetic particles and toner particles still have to be conveyed to the developing station.

SUMMARY OF THE INVENTION

Accordingly, it is a principal object of the present invention to provide a developing method and a developing apparatus having high developing efficiency, not having a negative property, which is capable of forming a developed image with high image density.

It is another object of the present invention to provide a developing method and a developing apparatus, whereby a developed image having sufficient image density can be provided without use of an automatic toner content control mechanism.

It is a further object of the present invention to provide a developing method and a developing apparatus wherein the developer on the developer carrying member is consumed efficiently According to an embodiment of the present invention, the development is effected not only by the toner particles on the surfaces of the magnetic particles carried on the developer carrying member but also by the toner particles of the toner layer formed on the surface of the developer carrying member. By using the toner particles in the toner particle layer for the development, the image density of the developed image is stabilized, and image quality is enhanced. Therefore, the image density is not influenced very much by the image density provided only by the toner particles on the magnetic particle surface, thus stabilizing the development operation. In some applications, the automatic toner content control means can be omitted. Simultaneously, the development efficiency can be increased up to as much as 70%, or even almost 100% in preferred conditions. One of the preferred conditions is that a volumetric ratio of the magnetic particles in the developing position is 1.5%–30% in order to further stabilize the development.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
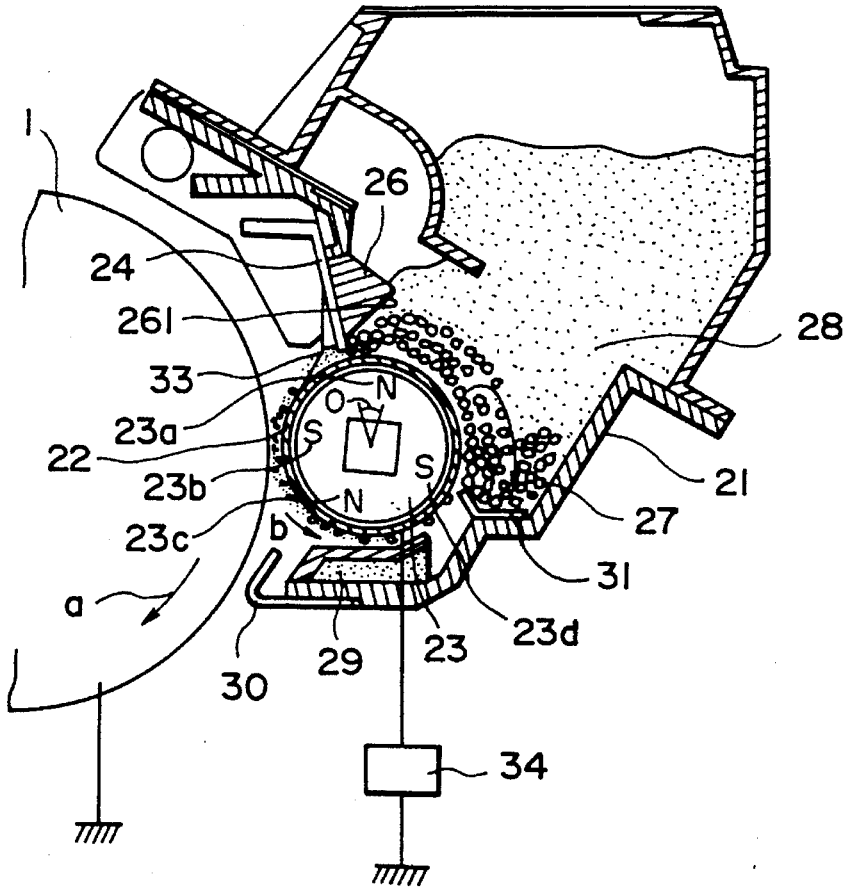
FIG. 1 is a sectional view of a developing apparatus according to an embodiment of the present invention.

Referring to FIG. 1, there is shown a developing apparatus according to an embodiment of the present invention, wherein an electrostatic latent image bearing member for bearing the electrostatic latent image to be developed is indicated by a reference numeral 1. The image bearing member 1 is in this embodiment a photosensitive drum, but may be a photosensitive or dielectric drum or belt movable along an endless path. The process of forming an electrostatic latent image on the image bearing member per se is not the novel feature of the present invention, and any suitable electrostatic latent image formation process is usable. In this embodiment, the image bearing member is a photosensitive drum on which an electrostatic latent image is formed an electrophotograpic process. The photosensitive drum 1 is rotatable in the direction indicated by an arrow a.

The developing apparatus according to this embodiment comprises a developer container 21, a developing sleeve 22 (hereinafter will be called simply "sleeve") as the developer carrying member, a magnet 23 as the magnetic field generating means, a regulating blade 24 (hereinafter will also be called simply "blade") for regulating the amount of the developer conveyed to the developing position on the sleeve 22 and an electric power source 34 as the alternating electric field generating means. The structures of the respective elements will be described.

The container 21 contains the developer containing the magnetic particles 27 and the toner particles 28 mixed together. The toner particle in this embodiment is a non-magnetic toner particle having a particle size of 7–20 microns, mainly consisting of 10 parts of carbon and 90 parts of polystyrene, for example. The toner particles and the magnetic particles are accommodated in this embodiment such that the magnetic particle content is high in the neighborhood of the sleeve 22 surface but it is low away from the sleeve 22 surface. However, they may be contained under uniform content in the container 21. The container 21 has an opening at a left bottom position, as seen in FIG. 1.

The sleeve 22 is made of a non-magnetic material such as aluminum and is disposed in the opening of the container 21 with a part of its surface exposed and the rest of the surface within the container 21. The sleeve 22 is rotatably supported along an axis perpendicular to the sheet of the drawing of FIG. 1 and is rotated in operation in the direction of an arrow b. In this embodiment, the sleeve 22 is illustrated as being a cylindrical sleeve, but it may be an endless belt.

The sleeve 22 is opposed to the photosensitive drum 1 with a small clearance to constitute a developing position or zone, to which the toner and magnetic particles are carried on the sleeve 22 so that the volumetric ratio of the magnetic particles therein is 1.5–30%. This will be described in detail hereinafter.

The magnet 23 is disposed in the sleeve 22. The magnet 23 is fixed so that it does not rotate when the sleeve 22 rotates. The magnet 23 has a magnetic pole 23*a* (N) cooperative with the blade 24 which will be described hereinafter to regulate the amount of the developer to be applied on the sleeve 22 as a developer layer, a developing pole 23*b* (S), magnetic poles 23*c* (N) and 23*d* (S) for collecting the developer after passing through the developing position back into the container 21. The polarities of the magnetic poles may be reversed. The magnet 23 is a permanent magnet in this embodiment, but it may be an electromagnet.

The blade 24 in this embodiment is made of a non-magnetic material such as aluminum at least at its free end portion. The blade 24 extends along the length of the sleeve 22 in the neighborhood of the upper portion of the opening of the container 21. The base portion of the blade 24 is fixed to the container 21. The free end of the blade 24 is opposed to the surface of the sleeve 22 with a clearance, which is 50–500 microns, preferably 100–350 microns. In this embodiment, the clearance is 250 microns. If the clearance is less than 50 microns, the clearance is easily clogged by the magnetic particles, whereas if it is larger than 500 microns, a too large amount of the magnetic particles and toner particles are passed through the clearance with the result that the suitable thickness of the developer layer can not be formed on the sleeve 22. The thickness of the layer is less than the clearance between the surface of the photosensitive drum 1 and the surface of the sleeve 22 at the developing position assuming that magnetic force does not exist. In order to form a developer layer of this thickness, it is preferable that the clearance between the edge of the blade 24 and the surface of the sleeve 22 is equivalent or smaller than the clearance between the surface of the photosensitive drum 1 and the surface of the sleeve 22. However, it is possible to form such a layer with a larger clearance between the blade 24 and the sleeve 22. At the inside wall of the blade 24, there is provided a member 26 effective to limit the circulating movement of the magnetic particles. The member 26 serves to limit the region of circulation of the magnetic particles within the container 21 which will be described hereinafter.

The power source 34 applies a voltage between the photosensitive drum 1 and the sleeve 22 to form an alternating electric field across the clearance therebetween, by which the toner particles transfer onto the photosensitive drum 1 from the developer layer on the sleeve 22. The alternating voltage provided by the power source 34 may be symmetrical, that is, the peak voltages at the positive side and the negative side are equal, or may be an asymmetrical voltage which may be provided by superimposing a DC voltage to the symmetrical voltage. As an example, when the electrostatic latent image having a dark portion potential of −600 V and a light portion potential −200 V is to be developed, the sleeve 22 is supplied with the asymmetrical voltage of 200–3000 Hz having a peak-to-peak voltage of 300–2000 Vpp provided by a superimposed DC voltage of −300 V, while the photosensitive drum 1 is grounded.

The bottom portion of the container 21 extends toward the photosensitive drum 1 to form an extension to prevent the developer, particularly the toner particles, from scattering or leaking outside. In order to assure such prevention, a member 29 is fixed to the top surface of the extension in this embodiment so as to receive and confine the developer particles. To the edge of the extension, a member 30 is fixed extending along the length of the sleeve 22 to prevent the particles from scattering, as shown. To the member 30, a voltage having the same polarity as the toner particles may be applied, whereby the toner scattered from the developing position is urged toward the photosensitive drum 1 by the electric field formed thereby, so as to prevent the toner scattering.

Adjacent the opposite ends of the sleeve 22, there is provided a developer limiting member 25, which functions to prevent the application of the developer on the sleeve 22 surface adjacent the longitudinal end portions of the sleeve.

The operation of the developing apparatus according to this embodiment will be described. First, the magnetic particles 27 are supplied into the container 21. Those magnetic particles are attracted and maintained on the sleeve 22 surface by the magnetic force provided by the magnetic poles **23*a* and 23*d* to cover the entire surface of the sleeve 22 within the container 21, thus forming a layer of magnetic particles. Those portions of the magnetic particle layer which are close to the magnetic poles 23*a* and 23*d* are formed into a magnetic brush. Subsequently, the toner particles 28 are supplied into the container 21, thus forming a toner layer outside the magnetic particle layer. It is preferable that the magnetic powder first supplied into the container 21 contains 2–70% by weight of the toner, but the powder may consist only of magnetic particles. After the magnetic particles 27 are once attracted to the surface of the sleeve 22 as the magnetic particle layer, they do not significantly flow or incline even when the developing apparatus vibrates or fairly inclines, and keep covering the surface of the sleeve 22**.

When the sleeve 22 rotates in the direction indicated by an arrow, the magnetic particles move upwardly in the direction along the surface of the sleeve 22 from the bottom portion of the container 21 to reach the neighborhood of the blade 24, where a part of the magnetic particles passes through the clearance between the sleeve 22 and the edge of the blade 24 together with the toner particles. The rest of the magnetic particles impinges on the member 26, and thereafter, are deflected downwardly and are lowered by gravity outside the rising passage to the bottom portion of the container 21. Such again rise by the rotation of the sleeve 22 adjacent thereto. This is repeated to form a circulation of the magnetic particles. Among the magnetic particles 27 rising toward the blade 24 from the bottom portion of the container 21, there are particles which turn downwardly prior to reaching the neighborhood of the blade 24. The magnetic particles relatively away from the surface of the sleeve 22 tend to make this movement.

The magnetic powder turned in the neighborhood of or before the blade 24 takes thereinto the toner particles from the outside toner layer. During the circulation with the rotation of the sleeve 22, the toner particles 28 are triboelectrically charged by the friction with the magnetic particles 27 and the sleeve 22 surface.

Adjacent the position before the blade 24, the magnetic particles 27 near the surface of the sleeve 22 are attracted to the sleeve surface by the magnetic force of the magnetic pole **23*a*, and therefore, they pass under the blade 24 to go out of the container 21 with the rotation of the sleeve 22. During this movement, the magnetic particles 27 carry the toner particles deposited on their surfaces out of the container 21. Additionally, a part of the charged toner particles 28 are attracted onto the sleeve surface by image force and are also carried out of the container 21 on the sleeve 22. The blade 24 is effective to such developer applied on the sleeve 22** surface.

The layer of the developer (the mixture of the magnetic particles 27 and the toner particles 28) formed on the sleeve surface 22 is carried on the surface of the sleeve 22 to reach the developing position or zone where the sleeve 22, and therefore, the layer is opposed to the surface of the photosensitive drum 1. In the developing position, the toner particles are transferred onto the latent image on the photosensitive drum 1 both from the surfaces of the magnetic particles and from the surface of the sleeve 22 by the alternating electric field formed across the clearance between the photosensitive drum 1 and the sleeve 22, whereby the latent image is developed. The volumetric ratio of the magnetic particles in the developing position is preferably 1.5–30%, which will be described in detail hereinafter.

With the continued rotation of the sleeve 22, the toner particles and magnetic particles not having been consumed for the development are collected back into the container 21. They are mixed with the particles in the container 21 by the above described circulation and are again supplied on the sleeve 22. During this circulation, the magnetic powder takes thereinto the toner particles from the upper toner layer in the container 21, whereby it is resupplied with the toner by the amount which has been consumed.

Figure 2:
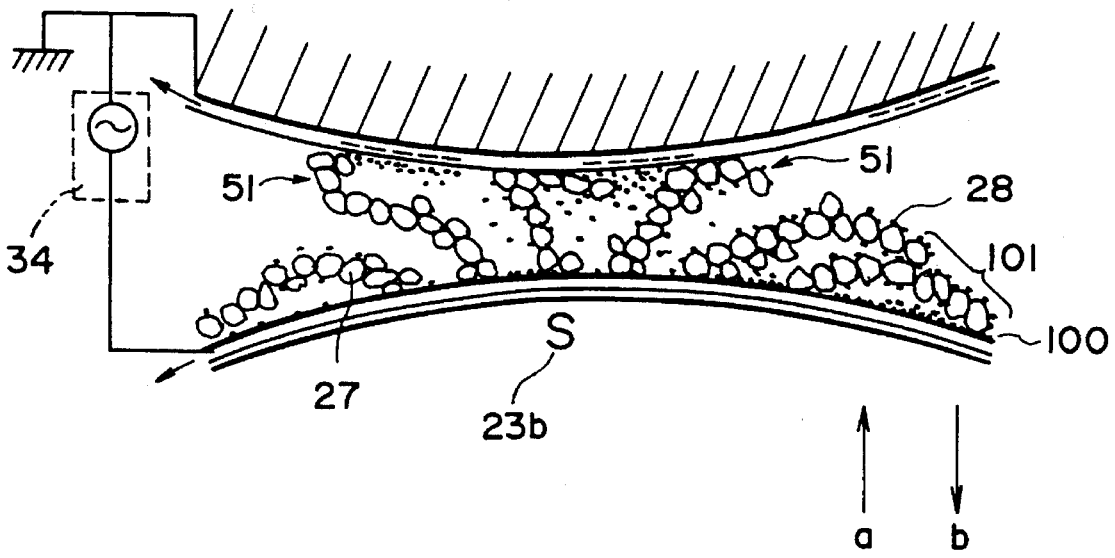
FIG. 2 is an enlarged sectional view at the developing position of the developing apparatus shown in FIG. 1, illustrating the method of development according to an embodiment of the present invention.

FIG. 2 is an enlarged sectional view of the developing position illustrating the developing action. The photosensitive drum 1 retains the electric charge constituting the latent image. In this embodiment, the electric charge constituting the latent image is negative, and therefore, the toner particles are charged positive. In FIG. 2, the photosensitive drum 1 and the sleeve 22 rotate such that the peripheral movements thereof are co-directional, as indicated by the arrows. Across the clearance formed therebetween, the above described alternating voltage is applied from the power source 34. At a position corresponding to a position where the photosensitive drum 1 and the sleeve 22 are closest, the magnetic pole **23*b* of the magnet 23 is disposed within the sleeve 22**.

In the space between the photosensitive drum and the sleeve 22, there is the developer which is the mixture of the magnetic particles 27 and the toner particles carried on the rotating sleeve 22. It should be noted that the developing system according to this embodiment is essentially different from those disclosed in the above mentioned U.S. Pat. Nos. 4,548,489, 4,579,082 and 4,563,978 in the existence of the magnetic particles in the developing position. Because of the volumetric ratio which will be described hereinafter, of the magnetic particles in the developing position, the amount of the magnetic particles present in this position is far less than in usual so-called magnetic brush developing system, and in this point, the developing system according to this embodiment is essentially different from those magnetic brush developing system. The very small amount of the magnetic particles 27 form sparse chains 51 of the magnetic particles by the magnetic pole **23*a*. Due to the larger movability of the magnetic particles 27 provided by this sparsity, the action of the magnetic particles 27** is unique.

More particularly, the sparse chains of the magnetic particles are distributed uniformly in the direction of the magnetic lines of force, and simultaneously, the surface of the sleeve 21 as well as the surfaces of the magnetic particles are opened. Therefore, the toner particles on the magnetic particle surfaces can be supplied to the photosensitive drum without obstruction by the chains, and simultaneously, the uniformly distributed opened portions of the sleeve surface can be established, whereby the toner particles can be transferred from the sleeve surface to the photosensitive surface by the alternating electric field.

Accordingly, from one aspect of the present invention, both of the toner particles 101 deposited or retained on the surfaces of the magnetic particles and the toner particles in the toner particle layer 100 (FIG. 2) on the developer carrying member surface are usable for the developing operation. Thus, substantially the entire surfaces of both of the magnetic particles are capable of functioning as extensions of the developer carrying member surface. At the same time, the toner particles deposited or retained on the developer carrying member surface can be utilized efficiently as the toner particles for developing movement. As a result, the amount of the toner particles in the toner particle layer 100 on the developer carrying member surface decreases to a large extent after it passes by the developing position as compared with that before passing thereby. Under the preferable conditions, the toner particle layer 100 no longer exists after the development. In other words, according to the present invention, the toner particles on the sleeve 100 is usable for the development, as well as the toner particles 101 on the magnetic particle surfaces.

The description will be made as to the behavior of the magnetic particles and the toner particles. As shown in FIG. 2, the electrostatic latent image in this example is formed by the negative charge (dark portion of the image), so that the electric field by the electrostatic latent image is directed as indicated by an arrow a in FIG. 2. The direction of the electric field provided by the alternating electric field alternates.

In the phase wherein the positive voltage is applied to the sleeve 22, the electric field is co-directional with the electric field of the latent image. At this time, the amount of the electric charge injected into the chains 51 is maximum, and therefore, the chains 51 stand up most, and long chains reach to the surface of the photosensitive drum 1. On the other hand, the toner particles 28 on the sleeve surface and the magnetic particle surfaces are charged in the positive polarity as described hereinbefore, and therefore, they are transferred to the photosensitive drum 1 by the electric field formed in this space. It should be noted here that the erected chains 51 are sparsely distributed, so that the surface of the sleeve 22 is exposed or opened, whereby the toner particles are released both from the surface of the sleeve 22 and the surfaces of the chains 51. Additionally, there is the electric charge having the polarity opposite to that of the toner paricles 28 in the chains 51, and therefore, the toner particles 28 on the surfaces of the chains 51 are easy to be released by the electrostatic repelling force.

During the phase wherein the negative voltage is applied to the sleeve 22, the electric field by the alternating voltage (arrow b) and the electric field by the electrostatic latent image (arrow a) are counter-directional. Therefore, the electric field in this space is strong in the opposite direction, so that the amount of charge injection is relatively small. Consequently, the chains 51 are collapsed in accordance with the amount of the charge, and they establish collapsed contact state.

Since the toner particles 28 on the photosensitive drum 1 are charged positive as described hereinbefore, the toner particles 28 transfer back to the sleeve 22 and back to the magnetic particles 27 from the photosensitive drum 1 by the electric field formed across the space. In this manner, the toner particles 28 reciprocate between the photosensitive drum 1 and the sleeve 22 surface and between the photosensitive drum 1 and the magnetic particle surfaces. With the increase of the clearance therebetween caused by the rotation of the photosensitive drum and the sleeve 22, the electric field is weakened, and the developing operation terminates.

At the chains 51, there are triboelectric charge by the friction with the toner particles 28 or image charge and charge injected by the electrostatic latent image charge on the photosensitive drum 1 and the alternating electric field between the photosensitive drum 1 and the sleeve 22. The state of those electric charges depends on the time constant of the charging and the discharging determined by the material of the magnetic particles 27 and other parameters.

Accordingly, the chains 51 of the magnetic particles 27 make minute but violent vibrating movement.

Now, the description will be made with respect to the volumetric ratio of the magnetic particles at the developing station. The "developing position" or "developing zone" is defined as the region in which the toner particles are transferred or supplied from the sleeve 22 to the photosensitive drum 1. The "volumetric ratio" is the percentage of the volume occupied by the magnetic particles present in the developing position or zone to the entire volume of the developing position or zone. As a result of the various experiments and considerations, the inventors have found that the volumetric ratio is significantly influential in this developing apparatus, more particularly, it is preferable that the volumetric ratio is 1.5–30%, more preferably 2.6–26%.

If this is smaller than 1.5%, the problems have been confirmed that the image density of the developed image is too low; that a ghost image appears in the developed image; a remarkable density difference occurs between the position where the chain 51 exists and the position where no chain exists; and or that the thickness of the developer layer formed on the sleeve 22 is not uniform.

If the volumetric ratio is larger than 30%, the surface of the sleeve is closed, that is, excessively covered by the magnetic particles so that a foggy background results.

It should be appreciated that the present invention is based on the finding by the inventors that the image quality does not consistently become better or worse with the increase or decrease of the volumetric ratio; that the satisfactory image density can be obtained within the range of 1.5–30% of the volumetric ratio; the deterioration of the image is recognized both below 1.5% and beyond 30% of the volumetric ratio; and that in this satisfactory range, neither the ghost image nor the foggy background results. The image deterioration resulting when the volumetric ratio is low is considered as being caused by the negative property, while the deterioration when the volumetric ratio is too large is considered as being caused by the closed or covered sleeve surface resulting from the large amount of the magnetic particles, thus reducing too much the toner supply from the sleeve surface.

If the volumetric ratio is less than 1.5%, the image reproducibility of a line image is not satisfactory with a remarkable decrease of the image density. If it is more than 30%, the magnetic particles can physically damage the surface of the photosensitive drum 1, and the toner particles may be retained on the photosensitive drum as a part of the developed image. This leads to an offset problem at the subsequent image transfer or image fixing station.

In the region where the volumetric ratio is near 1.5%, a locally non-uniform development can occur (under particular conditions) when a large area solid black image is developed. Accordingly, the volumetric ratio is determined such that this does not occur. For this purpose, it is more preferable that the volumetric ratio is not less than 2.6%, and therefore, this defines a more preferable range.

If the volumetric ratio is near 30%, the toner supply from the sleeve surface can be delayed in such a region adjacent the positions where the chains of the magnetic particles are contacted, for example, when the developing speed is high. If this occurs, a non-uniform developed image can result in the form of scales in the case of solid black image reproduction. In order to assure the prevention of this, the volumetric ratio is preferably not more than 26%.

Where the volumetric ratio is in the range of 1.5–30%, the chains 51 of the magnetic particles are formed on the sleeve surface and are distributed sparsely to a satisfactory extent, so that the toner particles on the chain surfaces and those on the sleeve surfaces are sufficiently opened toward the photosensitive drum 1, and the toner particles on the sleeve 22 are transferred by the alternating electric field. Thus, almost all of the toner particles are consumable for the purpose of development. Accordingly, the development efficiency (the ratio of the toner consumable for the development to the overall toner present in the developing position), and also a high image density can be provided. Preferably, the fine but violent vibration of the chains is produced, by which the toner powder deposited on the magnetic particles and the sleeve surface are sufficiently loosened. In any case, the trace of brushing or occurrence of the ghost image as in the magnetic brush development can be prevented. Additionally, the vibration of the chains enhances the frictional contact between the magnetic particles 27 and the toner particles 28, with the result of the increased tribo-electric charging to the toner particles 28, by which the occurrence of the foggy background can be prevented. Also, the high development efficiency is suitable to the reduction of the size of the developing apparatus.

The volumetric ratio of the magnetic particles in the developing position is determined;

$$(M/h)\times(1/\rho)\times[C/(T+C)]$$

where M is the weight of the developer (the mixture) per unit area of the sleeve surface when the erected chains are not formed ($g/cm^2$);

h is the height of the space of the developing position (cm);

ρ is the true density ($g/cm^3$);

C/(T+C) is the percentage of the magnetic (carrier) particles in the developer on the sleeve.

The percentage of the toner particles to the magnetic particles at the developing position as defined above is preferably 4–40% by weight.

In this embodiment, the alternating electric field is strong enough (large rate of change or large Vpp), the chains 51 are released from the sleeve 22 surface or from their base portions, and the released magnetic particles 27 also reciprocate between the sleeve 22 and the photosensitive drum 1. Since the energy of the reciprocal movement of the magnetic particles is large, the above described effect of the vibration are further enhanced.

The above described behavior has been confirmed by a high speed camera available from Hitachi Seisakusho, Japan operable at the speed of 8000 frames/sec.

Even in the case where the clearance is reduced between the photosensitive drum 1 surface and the sleeve 22 surface so as to increase the contact pressure between the photosensitive drum 1 and the magnetic particle chains 51 and to decrease the vibration, the clearance is still large enough at the inlet and outlet sides of the developing position, and therefore, the vibration is sufficient with the above described advantages.

On the contrary, if the clearance is increased it is preferable that the magnetic particle chains 51 contact the drum 1 surface when the electric field is applied, even if they do not contact the drum surface without the electric field.

When the magnetic particles having a relatively low resistance are used, the alternating voltage applied between the photosensitive drum 1 and the sleeve 22 is selected such that at the peaks thereof, the electric discharge does not occur therebetween at the dark portions or light portions of the latent image. When the chains of the magnetic particles having a relatively high resistance are used, the voltage is preferably selected such that the voltage across the clearance reaches a discharge on-set voltage by suitably selecting the frequency of the alternating voltage and selecting the charge and discharge time constant of the chains of the magnetic particles.

With those taken into account, the resistance of the entire chain in the direction of the height thereof measured with the chain being contacted to the photosensitive drum 1, is preferably $10^{15}$–$10^{6}$ ohm-cm. When the developing electrode effect of the chain 51 is expected, it is preferably $10^{12}$–$10^{6}$ ohm.cm, and more preferably $10^{10}$–$10^{6}$ ohm.cm.

The average particle size of the magnetic particles 27 is 30–100 microns, preferably 40–80 microns. In general, with decrease of the average particle size, the triboelectric charging property with the sleeve is improved, so that a so-called sleeve ghost (the image density decreases in the image which is developed immediately after a solid black image is developed, or the image density decreases gradually with the integrated number of rotations of the sleeve) does not result. However, when the particle size is small, there is a tendency that the magnetic particles are deposited onto the latent image bearing member. The positions where the magnetic particles are deposited, are different depending on the resistance of the magnetic particles. For example, relatively low resistance magnetic particles are deposited on the image area of the latent image, while high resistance particles are deposited in the non-image area. This is a general tendency, and actually the influence is recognized more or less by the magnetic properties of the magnetic particles, the surface configuration and the surface treating material (including resin coating).

In the developing apparatus used with commercial electrophotographic machines, wherein the magnetic field on the sleeve in the developing position is approximately 600–900 Gausses, it has been found that the magnetic particles are increasingly deposited when the size thereof is not more than 30 microns. On the contrary, if it is not less than 100 microns, the sleeve ghost is remarkable. Therefore, the range of 30–100 microns is preferable. In the developing apparatus according to this embodiment, a relatively high resistance carrier particles having the particle size of 50–100 microns for a two component developer, are usable.

The magnetic particle may contain only magnetic material or may contain both magnetic material and non-magnetic material. In addition, the magnetic particle may contain two or more magnetic materials mixed.

Next, the description will be made with respect to a so-called V-D curve, that is, the relation of the developed image density with respect to the surface potential of the latent image in the developing apparatus according to this embodiment.

Figure 3:
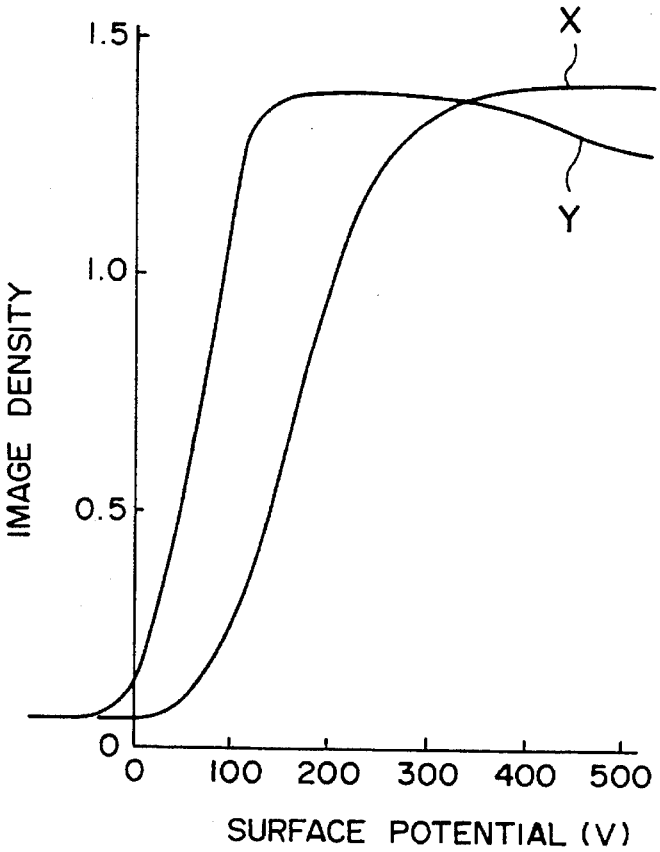
FIG. 3 is a graph indicating the development property of the developing apparatus according to the embodiment of the present invention.

FIG. 3 is a V-D curve graph, wherein the V-D curve in this apparatus is indicated by a reference X, and wherein the reflection density of the developed image measured by a Macbeth density meter is plotted against the potential difference between the photosensitive drum potential and the sleeve surface potential when the sleeve surface potential is assumed to be zero. It is understood that the V-D curve is excellent since it indicates that the background fog does not result at the low potential region, and the appropriate inclination is provided in the intermediate potential region, and still the sufficient image density can be provided at the high potential region. As an example of a V-D curve of a developing apparatus not using the present invention, that of the developing apparatus disclosed in U.S. Pat. Nos. 4,548,489, 4,579,082 and 4,563,978 wherein one component non-magnetic developer layer is opposed to a latent image under the existence of an alternating electric field, the developer layer being thin on the sleeve surface, is given in FIG. 3 and is indicated by a reference Y. As will be understood, the negative developing property appears, that is, in a range beyond a certain potential, the image density decreases with increase of the potential. This provides a tendency that the image density is not sufficient in a high potential region. As contrasted to this V-D curve, the property of the present invention is much better, since the foggy background is not produced in the low potential region; since the inclination is relatively less steep in the intermediate region, and therefore, the edge effect is not extreme; since the negative property does not appear in the intermediate potential region; and since the sufficient image density can be obtained in the high potential region.

Then, the conditions will be discussed to form preferable chains of the magnetic particles.

Figure 4:
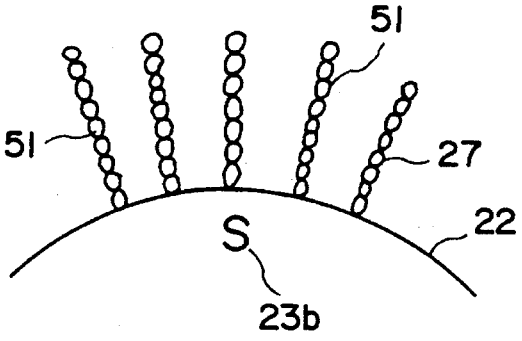
FIG. 4 is a sectional view illustrating a preferable formation of chains of the magnetic particles in the developing apparatus according to the present invention.

FIG. 4 illustrates the chains which are preferable in the developing position, wherein the chains are formed independently from each other and wherein the chains are distributed uniformly over the sleeve 22 surface.

Figure 5:
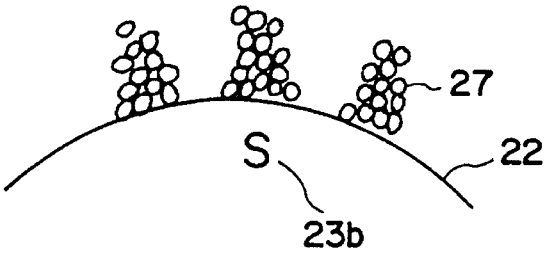
FIG. 5 is a sectional view illustrating an unpreferable formation of chains of the magnetic particles.

FIG. 5 illustrates chains which are not preferable, wherein the magnetic particles 27 are in the form of masses. It has been found that if the development is effected with those masses of the magnetic particles, non-uniform pattern in the form of scales have appeared in an image, and therefore, this is not preferable.

Further, the inventors have found that the production of the mass of the magnetic particles is influenced by the material of the blade 24 and by an angle between the edge of the blade and the magnetic pole 23a seen from the center of the sleeve 22.

As for the material of the blade 24, non-magnetic material is preferable. When magnetic material is used, the magnetic lines of force are concentrated on the blade 24, with the result that the magnetic force for confining the magnetic particles is strong. In order for the magnetic particles to overcome the confining force and to go out of the container 21, a mass over a certain degree is required. Until such a mass is reached, they stay in the neighborhood of the blade 24 due to the strong magnetic confining force. Only when the mass reaches a sufficient level, the mass of the magnetic particles becomes able to advance out of the container 21. This is considered as being the reason why the magnetic particles are in the form shown in FIG. 5 when they reach the developing position on the sleeve 22.

Where the blade 24 is of non-magnetic material, the magnetic lines of force do not concentrate adjacent the edge of the blade 24, and therefore, the above-described mass is not produced, but the developer is applied uniformly over the sleeve. Consequently, the uniform and sparse chains are formed in the developing position. For this reason, the blade 24 is preferably of a non-magnetic material. However, if the magnetic property is weak as when provided by bending a stainless steel (SUS304-JIS), such a magnetic material is usable.

As to the angle θ, if it is less than 2 degrees, the mass of the magnetic particles is produced, or the developer is not formed as a uniform layer on the sleeve 21. The reason for this is considered as follows. Since then, the magnetic particles are sparsely distributed along the magnetic lines of force adjacent the blade 24, and therefore, the magnetic particles are advanced only after a predetermined amount of the magnetic particles are stagnated here. On the other hand, if the angle θ is larger than 40 degrees, the effect of regulating the amount of the magnetic particles is extremely decreased. From this, it has been found that the angle θ is preferably not less than 2 degrees but not more than 40 degrees, further preferably, not less than 5 degrees but not more than 20 degrees.

The relationship between the angle θ and the amount of the developer passed under the blade edge is like this. With the decrease of the angle θ, the amount decreases, and therefore, the volumetric ratio at the developing station decreases. If the angle θ is increased, the opposite results. The amount of the toner particles applied on the surface of the sleeve 22 is substantially independent from the angle θ, that is, it is substantially constant.

A developing apparatus was constructed according to this embodiment, as shown in FIG. 1. As for the sleeve 22, an aluminum sleeve having the diameter of 20 mm was used after the surface thereof was treated by irregular sandblasting with ALUNDUM abrasive. Within the sleeve 22, the magnet 23 magnetized with four poles was used, the N and S poles being arranged alternately along the circumference as shown in FIG. 1. The maximum surface magnetic flux density by the magnet 23 was approximately 900 Gauss.

The blade 24 used had the thickness of 1.2 mm made of non-magnetic stainless steel. The angle θ was set at 15 degrees.

As for the magnetic particles, ferrite particles (maximum magnetization of 60 emu/g) had the particle size of 70–50 microns (250/300 mesh), whose surface was treated by silicon resin.

As for the non-magnetic toner, blue powder provided by a mixture of 100 parts of styrene/butadiene copolymer resin and 5 parts of copper phthalocyanine pigments, and added by 0.6% of the colloidal silica, was used. The average particle size of the toner particles was 10 microns. Upon operation, approximately 20–30 microns thickness of the toner layer was obtained on the sleeve 22 surface, and above the toner layer, the magnetic particle layer of 100–200 microns thickness was formed. On the surfaces of the magnetic particles, there were toner particles.

At that time, the total weight of the magnetic particles and the toner particles on the sleeve 22 was approximately $2.43\times10^{-2}$ g/cm$^2$.

The magnetic particles were formed into erected chains at and adjacent the developing position by the magnetic pole 23*b* within the sleeve 22. The maximum height of the chains was approximately 0.9 mm.

The amount of electric charge was measured by a blow-off method, and the triboelectric charge of the toner particles on the sleeve 22 and the magnetic particles was +10 mC/g.

The developing apparatus was assembled into a commercial copying machine, PC-10 sold by Canon Kabushiki Kaisha, Japan. The clearance between the surface of the photosensitive drum 3 made of organic photoconductor material and the surface of the sleeve 22 was set 350 microns. They were moved at the same peripheral speed, more particularly 66 mm/sec. The volumetric ratio under those conditions was approximately 10% (h=350 microns, M=$2.43\times10^{-2}$ g/cm$^2$, p=5.5 g/cm$^3$, C/(T+C)=20.4%). The bias voltage source 34 provided an alternating voltage having the frequency of 1600 Hz, wherein an alternating voltage having the peak-to-peak value of 1300 V was superimposed with a DC voltage of −300 V. When this was operated, good blue images were obtained.

The developing operation was performed to obtain a solid image, and then the surface of the sleeve 22 was carefully observed after the developing operation. It was confirmed that almost all of the toner particles on the sleeve and on the magnetic particles were consumed, and therefore, the developing operation was effected with almost 100% development efficiency.

It was confirmed that the development properties were good enough without foggy background, and the V-D curve was as indicated by the reference X in FIG. 3.

As described in the foregoing, the present embodiment is advantageous in the high image density, high development efficiency, no foggy background, no ghost image, no trace of brushing and no negative property.

As will be understood from FIG. 1, the developer circulation limiting member 26 is disposed upstream of the developer regulating member 24 with respect to the movement of the sleeve surface. The limiting member has a (bottom) surface which defines a clearance with the surface of the sleeve 22, the clearance decreasing toward the regulating member 24. This is preferable to turn the developer downwardly. In this embodiment the angle θ is 15 degrees so that the magnetic brush is formed in the region between the limiting member 26 and the sleeve 22 opposed to each other. Another aspect of the present invention will be described.

Further, the inventors have found that the state of the magnetic particles immediately before the blade 24 is important in order to assure the formation of the developer layer on the sleeve surface and to further stabilize the developing operation.

In order to perform the developing operation in good order, it is required that the toner particles in the developer layer are uniformly triboelectrically charged to a proper extent. If the charge of the toner is low or uneven, the background fog tends to occur. If, on the contrary, the charge is too large, the toner particles stick to the surface of the sleeve 22 or the surfaces of the magnetic particles 27 with the result of incapability of being consumed for the development, so that the image density is low, or the image is partly void. For this reason, the mechanism is important in which the toner particles are taken into the magnetic powder, and wherein the triboelectric charge is applied to the toner particles. The application of the triboelectric charge to the toner depends on the state of the developer immediately before the blade 24.

Figure 6:
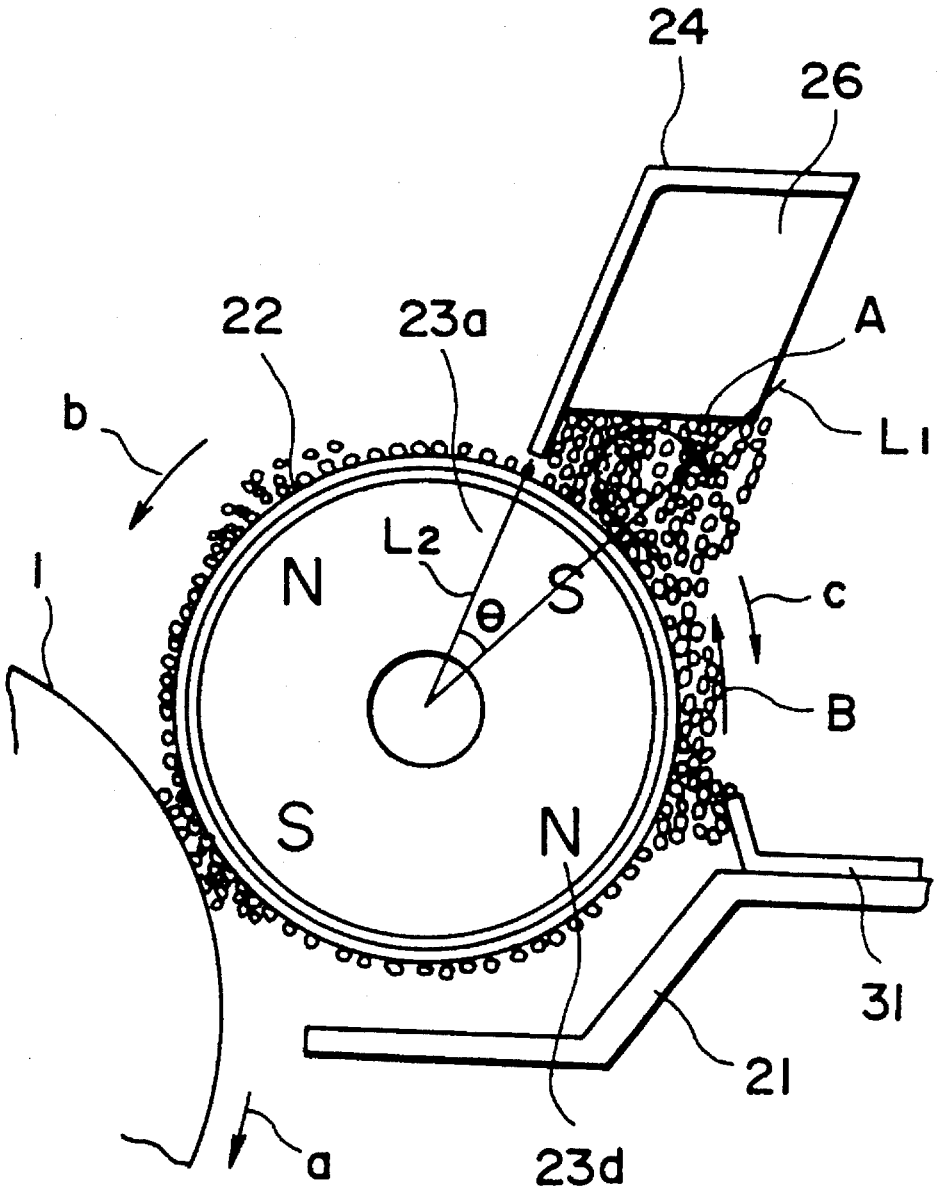
FIG. 6 is a sectional view of a part of a preferable example of a developer container.

FIG. 6 is a sectional view of a part of the developing apparatus according to another embodiment of the present invention, wherein like reference numerals have been used to describe corresponding elements.

As described hereinbefore, the magnetic particles circulate with the rotation of the developing sleeve 22. The circulating movement can be divided into-three parts. The first part is indicated by a reference A in FIG. 6, which is immediately before the blade 24 (hereinafter will be called "circulation layer A"). Here, the developing particles circulate at a very low speed.

The second part extend from a magnetic seal 31 to the circulation layer A (hereinafter will be called "conveying layer B"), in which the magnetic particles are conveyed by the rotation of the sleeve 22. In this conveying layer B, the toner particles are mainly taken into the magnetic powder.

The third part is indicated by a reference C, which hereinafter will be called "falling layer", wherein the magnetic particles fall by the gravity. The falling layer C is remarkably formed particularly when the amount of the magnetic particles is large or when the T/C ratio in the magnetic particle layer is increased so that the volume of the magnetic particle layer is large.

The movement in the falling layer C is moderate, and therefore, the power of taking the toner particles is weaker than in the conveying layer B. Thus, with respect to taking the toner particles into the magnetic powder, there are two processes. One of them occurs when the ratio T/C is low in the magnetic particle layer. In this case, the above described falling movement in the falling layer C is not strong, and the toner is taken into the magnetic powder by the movement in the conveying layer B, thus increasing the toner content T/C in the magnetic particle layer.

The other occurs when the toner content T/C is high in the magnetic particle layer. In this case, the movement has been stabilized in the magnetic particle layer, and the movement in the falling layer C is strong, with the result that the conveying layer B hardly contacts the toner layer. At this time, the toner taking action occurs only during the downward movement of the magnetic particles in the falling layer C, and the amount is slight. Therefore, the toner content T/C does not increase. In this manner, the toner content in the magnetic particle layer is kept substantially constant.

The application of the triboelectric charge to the toner particles can be provided also by the movement in the conveying layer B, but the application in the circulation layer A, particularly adjacent the blade 24, is predominant. Here, the force of conveying the magnetic particles by the sleeve 22 and the force of limiting this movement and assisting the turn of the magnetic particles by the circulation limiting member 26, cooperate to increase the pressure among the magnetic particles, and the density of the particles is increased immediately before the blade 24, by which the toner particles are sufficiently frictioned with the surface of the sleeve 22 and the magnetic particles 27 so that the toner particles are electrically charged.

If the pressure (density) is low, the frictional force to the toner particles is weak, which results in low and non-uniform electric charge of the toner. This can be a cause of the foggy background. If, on the contrary, the pressure, and therefore, the density is too high, the frictional force is too strong with the result of extremely charged toner particles. If this occurs, the toner particles are overcharged and/or fused and fixed onto the sleeve surface or the surfaces of the magnetic particles, which is not desirable.

It has been found that the triboelectric charge application power is not represented only by the absolute value of the density of the magnetic powder.

This is because the toner content T/C can widely range from 0.10–0.3 in the developing apparatus according to this embodiment, and therefore, the absolute value of the density of the magnetic powder changes depending on the amount of the toner. When only the magnetic particles are contained in the space at the most condensed state, the total volume of the magnetic particles to the volume of the space is $(1/6)\pi\sqrt{2}=74\%$ if a face-centered cube is considered (Introduction to Solid State Physics by Charles Kittle). However, if the toner particles are contained therein by the amount of 20% by weight of the magnetic particles, the amount of the magnetic particles in the space is as low as 30% even under the most condensed condition. If the 20% toner is contained and if the volume of the magnetic particles is 30% in the region immediately before the blade 24, the toner particles are easily charged too much. If several % by weight toner is contained, and if the volume of the magnetic particles is 30% immediately before the blade 24, a cavity or cavities are produced in the developer powder, into which the toner particles floating in the developing apparatus come, and they are deposited before being triboelectrically charged. This may be a cause of the foggy background. The inventors have found a particular relationship existing between the amount of the magnetic particles at the developing position and the amount of the magnetic particles immediately before the blade 24.

The amount of the magnetic particles at the developing station changes depending on the toner content T/C. And the proper amount of the magnetic particles immediately before the blade 24 is also dependent on the toner content T/C. If they satisfy particular relation, sufficient triboelectric charge can be applied, and satisfactory developer layer can be provided independently of the ratio T/C. The relation is:

$$0.1 \leqq Vd/V \leqq 1.0$$

where

V is a volumetric ratio of the magnetic particles in the region immediately before the blade;

Vd is a volumetric ratio of the magnetic particles at the developing station.

Those conditions are satisfied under the conditions that the above described development are accomplished.

More preferably, the relation is:

$$0.2 \leqq Vd/V \leqq 0.8$$

Further preferably, the volumetric ratio Vd satisfies $1.5\% \leqq Vd \leqq 30\%$ as described hereinbefore.

If $Vd/V<0.1$, the magnetic particle layer tends to be clogged immediately before the blade 24, so that it is difficult to uniformly form the developer layer. In this state, the frictional force to the toner particles is too strong with the result of extremely charged toner particles.

If $Vd/V>0.1$, the magnetic particle layer is fairly sparse, and the above described entering of the floating toner can not be prevented to the satisfactory extent, so that foggy background is produced.

The above analysis is based on the volumetric ratio Vd ($1.5\% \leqq Vd \leqq 30\%$). Based on the volumetric ratio V, the ratio Vd/V is preferably 0.8 or less when the volumetric ratio V is approximately 40%. Also, it is preferable that $Vd<V$ is satisfied within the range where the volumetric ratio Vd satisfies the above requirement.

In the first embodiment described in conjunction with FIG. 1, the volumetric ratio V was set 40%, and the volumetric ratio Vd was set 10%. In that case the value $Vd/V=0.25$. The bias voltage applied by the voltage source 34 had the frequency of 1600 Hz and was obtained by superimposing the DC voltage of −300 V to the AC voltage of the peak-to-peak voltage of 1300 V. The resultant blue image was satisfactory.

A solid image was developed, and the sleeve surface after the development was observed. It was confirmed that almost all of the toner particles on the magnetic particles and or the sleeve 22 was consumed up. Namely, the development efficiency was almost 100%.

The region immediately before the blade 24 is represented by the space or region A defined by the blade 24, the limiting member 26 and the sleeve 22. Where the volume of the region A thus defined is very large, the representative volume of the region is determined as a volume of the space defined by the blade 24, the surface of the sleeve 22 and an extension of a line connecting the center of the magnetic pole **23*a* adjacent the blade 24 and the rotational center of the Sleeve 22. In any case, the volumetric ratio of the magnetic particles in the region immediately before the blade 24 is the maximum within the container 21**, and therefore, this is used.

It is preferable that the volumetric ratio in the region immediately before the blade 24 is not less than 20% from the standpoint of the stabilized charge application to the toner particles.

A further aspect of the present invention will be described.

In this embodiment, the toner particles are retained on the magnetic particle 27 surfaces and the sleeve 22 surface. The inventors have determined as a consequence of various experiments and considerations that the ratio of those toner particles, more particularly, the ratio between the toner particles retained on the magnetic particles and the toner particles retained on the sleeve, is 1:2–10:1 by weight, more preferably, 1:1–5:1.

This ratio can be controlled by changing the surface property of the sleeve 22, the triboelectric charging property of the toner particles and/or the property and the supply of the magnetic particles. Among those factors, the particle size of the magnetic particles and the amount of the magnetic particles supplied to the developing position are particularly influential.

With the increase of the particle size of the magnetic particles, the area of the surfaces capable of retaining the toner particles decrease (for the purpose of comparison, the total volume of the magnetic particles is supposed to be constant). Therefore, the amount of the toner retained on the magnetic particles, which is conveyed to the developing position, decreases. On the contrary, the amount of the toner particles retained on the sleeve 22 increases as if it compensates the reduction of the toner particles retained on the magnetic particles. If the particle size of the magnetic particles is reduced, the opposite tendencies result.

As for the amount of supply of the magnetic particles to the developing position, the amount of toner particles retained on the magnetic particles increases with the increase of the supply of the magnetic particles. With this increase, the amount of the toner retained on the sleeve 22 decreases slightly. If the supply of the magnetic particles is reduced, the tendencies are opposite.

Therefore, by suitably selecting those factors, the above region of the ratio can be provided.

If the above ratio is less than 1:2, the V-D curve approaches the curve Y shown in FIG. 3, and therefore, not preferable. If it is more than 10:1, on the contrary, the magnetic particles 27 are contacted to the surface of the photosensitive drum 1 too much with the result that the magnetic particles 27 are deposited on the photosensitive drum 1. This is not preferable, either. It has been confirmed that the good image results when the above ratio is within the range of 1:2–10:1. As described, by properly selecting the particle size of the magnetic particles and the supply of the magnetic particles, the ratio is set within the range of 1:1–5:1, which is more preferable for the satisfactory development.

The ratio is measured in the following manner. First, all of the magnetic particles on the sleeve 22 is attracted from the sleeve 22 by a magnet. By doing so, the magnetic particles and the toner particles retained thereon are all collected to a magnet. The same is rinsed, and the amount of the toner which has been retained on the magnetic particles is measured in weight. Then, the toner particles remaining on the sleeve 22 is all removed and collected by a filter. Again, it is rinsed, and the weight of the toner particles which have been retained on the sleeve is measured. As an alternative, the magnetic particles on the sleeve 22 is externally attracted by a magnet and rinsed, and thereafter, another developer layer is formed. Then, the developer layer (the magnetic particles, the toner particles retained on the magnetic particles and the toner particles retained on the sleeve) are all removed and rinsed to determine the total amount of the toner. Then, the amount of the toner particles on the sleeve 22 is obtained as a difference between the total amount of the toner and the amount of the toner retained on the magnetic particles. This alternative method is usable when the developing operation is sufficiently stabilized.

The description will be made with respect to the amount of the developer carried on the sleeve 22, more particularly the amount of the developer (the total of the magnetic particles and toner particles) on the sleeve 22 downstream of the blade 24. Various experiments and considerations by the inventors have revealed that in the developing apparatus according to this embodiment, when the magnetic particles are each substantially spherical, the amount of the developer is preferably $0.5–5.0\times10^{-2}$ g/cm$^2$. If it is larger than $5.0\times10^{-2}$ g/cm$^2$ the foggy background is produced Particularly, if it is larger than $6.0\times10^{-2}$ g/cm$^2$, the background is extremely foggy. If it is smaller than $0.5\times10^{-2}$ g/cm$^2$ on the contrary, the trace of the brushing is visible with naked eyes. Therefore, the above range is preferable.

With respect to the ratio of mixture between the toner and magnetic particles, the inventors experiments and considerations have revealed that the ratio of the toner weight to the magnetic particle weight is preferably 4–40%. With the ratio larger than 40%, the foggy background is produced independently of the amount of the developer applied on the sleeve 22. If it is smaller than 4%, no satisfactory image density is provided independently of the amount of the developer applied on the sleeve 22. Therefore, the above range is preferable.

Referring back to the ratio of the toner particles retained on the magnetic particles and the toner particles retained on the sleeve, the ratio was approximatelly 2:1 by weight in the above described actual example of the developing apparatus according to this embodiment. It should be noted that if the ratio is within this range, the change in the amount of the toner particles retained on the magnetic particles is substantially compensated by the toner particles retained on the sleeve, so that the stabilized developing operation can be maintained even if the amount of the toner on the magnetic particles varies more or less.

Yet another aspect of the present invention will be described.

A further preferable condition will be described. This condition is that the amount of the toner particle layer on the sleeve 22 surface carried to the developing position is not less than $0.05\times10^{-3}$ g/cm$^2$ and not more than $1.0\times10^{-3}$ g/cm$^2$.

As described hereinbefore, the above described developing action is based on the toner particle layer on the surface of the sleeve 22 as well as the toner particles on the toner particles retained on the surfaces of the magnetic particles and on the action of the magnetic particles. The developing action is governed or supplemented by the toner particle layer on the sleeve 22. This is particularly so, when the chains of the magnetic particles formed in the developing position by the action of the magnetic field is so sparsely distributed on the surface of the sleeve 22 that the toner particle layer on the surface of the sleeve is opened to the latent image bearing member (drum). To accomplish this, the volumetric ratio defined hereinbefore of the magnetic particles in the developing position is not more than 50%, for example.

In any event, in the developing apparatus according to this embodiment of the present invention the toner particles in the toner particle layer on the surface of the sleeve 22 between the chains of the magnetic particles are transferable to the latent image bearing member without restraint by the magnetic particles. Therefore, the toner particle layer is influential to the result of the development.

From this aspect, the amount of the toner particles in the toner particle layer carried on the sleeve 22 to the developing position is preferably not less than $0.05\times10^{-3}$ g/cm$^2$ and not more than $1.0\times10^{-3}$ g/cm$^2$. If it is less than $0.05\times10^{-3}$ g/cm$^2$, the amount of the toner usable for development is not sufficient with the result that low image density portion is produced and that a line image is thinned. This is so, even if a quite large amount of toner particles are made to be retained on the magnetic particles. If, on the other hand, it is larger than $1.0\times10^{-3}$ g/cm$^2$ the amount of the toner particles is too large with the result that the developed image is thickened and/or defaced and that the foggy background is produced. This is so, even if the amount of the toner particles retained on the magnetic particles is made significantly reduced. If it is $0.05\times10^{-3}$ g/cm$^2$–$1.0\times10^{-3}$ g/cm$^2$ the developing action is stabilized since, if the amount of the toner particles retained on the magnetic particles varies, the toner particles on the sleeve surface can supplement or compensate the variation.

Under the condition of the above described toner particle layer formed, the ratio described hereinbefore between the toner particles retained on the magnetic particles and the toner particles retained on the sleeve, is 1:2–10:1 by weight further stabilize the developing operation.

In addition, the volumetric ratio of the magnetic particles at the developing position (1.5–30%) further ensures the function of the toner particle layer described above.

It has been confirmed that if the toner particle layer is not less than $0.1\times10^{-3}$ g/cm$^2$ and not more than $0.6\times10^{-3}$ g/cm$^2$ the stabilized developing operation can be maintained satisfactorily, even if the above described other conditions are varied or if there is some variation in the ambient conditions. This is because the development according to this embodiment effectively uses the toner retained on the magnetic particles and also the toner retained on the sleeve surface.

It is preferable that the toner particle layer is spaced from the latent image bearing member at the developing position. The thickness of the toner layer is preferably not less than 1/50 and not more than 1/5 of the clearance between the electrostatic latent image bearing member 1 and the sleeve 22 at the developing position in view of the transfer of the toner particles.

The above described amount and ratio can be measured in the same manner as described hereinbefore.

In the above described example, the amount of the toner applied on the sleeve surface was measured and found to be $0.1\times10^{-3}$ g/cm$^2$–$0.6\times10^{-3}$ g/cm$^2$.

A still further aspect of the present invention will be described.

Next, the description will be made with respect to the peripheral speeds of the photosensitive drum 1 and the sleeve 22. As described hereinbefore, the image quality is significantly influenced by the presence of the toner particles and the magnetic particles in the clearance between the photosensitive drum 1 and the sleeve 22. It is therefore preferable to pay consideration to the peripheral speed difference between the photosensitive drum 1 and the sleeve 22, more particularly, they are substantially equal. Further, the peripheral speed of the sleeve 22 is preferably 1.5–0.8 times the peripheral speed of the photosensitive drum 1.

If the peripheral speed of the sleeve 22 is less than 0.8 time of that of the photosensitive drum 1, the amount of the developer (the toner particles on the sleeve 22 and the toner particles on the surfaces of the magnetic particles) which is capable of being supplied to the electrostatic latent image while the latent image passes by the developing position, is very small, with the result that the density of the developed image is low, and that the distribution of the portion where the chains 51 exist and the portions where they do not exist is not stabilized so that a local density difference appears. Those inconveniences occur depending on the particle size of the magnetic particles or toner particles. Thus, the developer usable is more limited.

If the peripheral speed of the sleeve 22 is higher than 1.5 times of the photosensitive drum peripheral speed, the amount of the magnetic particles present at the developing position per unit time is so large that the sufficient vibration of the chains is not provided. It is recognized that the toner supply from the sleeve surface is delayed adjacent the area where the chains of the magnetic particles are contacted to the photosensitive member 1. In an extreme case, a non-uniform pattern in the form of scales is observed in the very high density portion as in the case of a solid black image. Additionally, the insufficient vibration per unit time at the developing position sometimes prevents the active frictional contact between the magnetic particles and toner particles, and therefore, the triboelectric charge to the toner particles is insufficient. This results in foggy background of the developed image.

Accordingly, the peripheral speed of the sleeve 22 and that of the drum 1 are kept substantially equal, more particularly, the peripheral speed of the sleeve 22 is 1.5–0.8 times that of the drum peripheral speed. By doing so, the action and behavior of the relatively slight amount of the magnetic particles existing at the developing position are most effectively utilized.

It should be noted that this does not apply to the conventional magnetic brush development using two component developer (the peripheral speed of the sleeve is more than twice the peripheral speed of the drum, practically it is 4–8 times). This stems from the fact that the developing apparatus according to this invention effectively uses the transfer of the toner particles from the surface of the sleeve, and uses the balance with the toner supply from the surfaces of the magnetic particles under the action of the magnetic particles.

A further aspect of the present invention will be described.

As described hereinbefore, the conventional magnetic brush development using two component developer, there is a problem of a trace of the brushing in the developed image. This is particularly remarkable in a small size developing apparatus. The reason is considered as being that the diameter of the sleeve is small resulting in a stronger curvature of the sleeve surface. Additional reason is in the recent tendency toward the high speed development.

Figure 8:
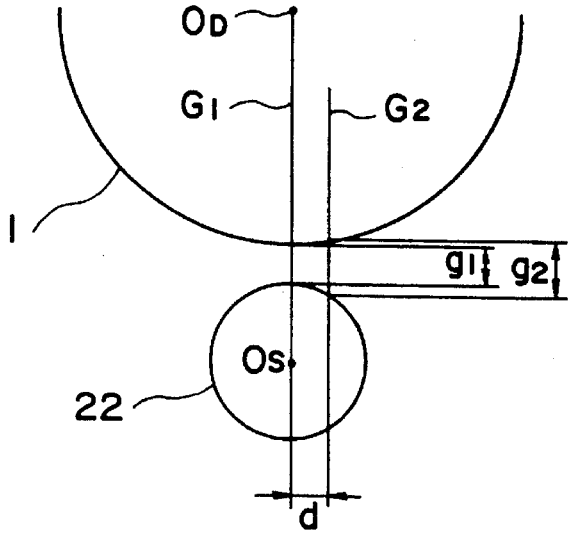
FIG. 8 is a sectional view illustrating the dimensions of the developing position.

FIG. 8 illustrates the configuration of the developing zone from the standpoint of the curvature (a reciprocal of the radius of a curve).

In this Figure, a line (as seen in the cross-section of FIG. 8) connecting points on the photosensitive drum surface and the sleeve surface which are most close to each other is represented by a reference G1. In this embodiment, the line passes through the center OD of the photosensitive drum 1 and the center OS of the sleeve 22. The clearance between the photosensitive drum 1 and the sleeve 22 is $g_1$ (mm), measured along the line G1. A line G2 is drawn, parallel to the line G1 and spaced apart therefrom by a distance d (2 mm). The clearance between the photosensitive drum 1 and the sleeve 22 measured along the line G2 is $g_2$ (mm). The difference ($g_2$–$g_1$) in the clearances increases with the increase of the curvature, that is, the decrease of the diameter or radius of the photosensitive drum 1 and/or the sleeve 22.

According to the inventor's experiments and considerations, the curvatures at the developing position and the clearance difference between the central portion and the developing terminating portion of the developing position influence the developing property, and the influence is different if the developing method is different. More particularly, in the developing apparatus of this kind, the width of the developing position is approximately 4 mm, and therefore, the clearance difference between the center position and the position 2 mm away therefrom is important.

The description will be made with respect to the relationship between the image density of the developed image against the surface potential of the latent image, that is, a so-called V-D curve and also with respect to the image quality and the curvature at the developing station.

Figure 7:
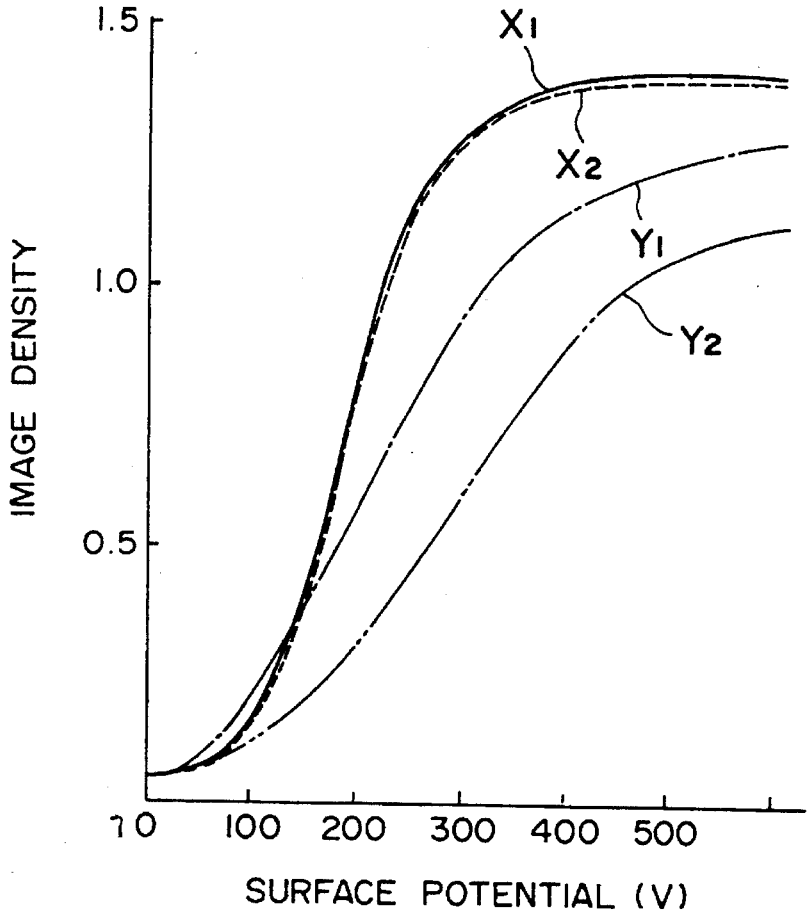
FIG. 7 is a graph indicating the development property of the developing apparatus according to the present invention.

FIG. 7 is a V-D curve, wherein the reference X1 represents the case where the curvature is small, while a reference X2 represents the case of a large curvature. In this graph, an optical reflective image density measured by a Macbeth reflective image density meter is plotted against the potential difference between the surface of the photosensitive drum 1 and the surface of the sleeve 22, with the sleeve potential assumed to be zero. This property is excellent in that no foggy background is produced in the low potential region, that the proper inclination of the V-D curve is exhibited in the intermediate potential region, and that the sufficient image density can be provided without local void in the case of solid black image. Additionally, it is understood that the property is not significantly influenced by the curvature. It has been confirmed that the solid black image is free from the void and is uniform independently of the curvature.

As an example of a developing apparatus not using the present invention, the same properties are measured with a developing apparatus using one component magnetic developer as disclosed in the U.S. Pat. Nos. 4,395,476, 4,425,373 and 4,292,387. The V-D curve in this case is indicated by a reference Y1 or Y2, wherein Y1 represents the small curvature case, while Y2 represents a large curvature case. It will be understood, that the inclination is less steep in the region from the low potential portion to the intermediate potential portion, but in the high potential portion, the image density tends to be insufficient, and this tendency is remarkable when the curvature is large, that is, when the radius of curvature is small.

From the standpoint of the image quality, the so-called edge effect is stronger, by which a middle portion of a solid black image is less dense. Additionally, the leading edge portion of the image is slightly light as compared with the trailing edge of the image. This is also remarkable particularly when the curvature is large. As contrasted to this, the developing apparatus according to the present invention is capable of forming the developed image without the foggy background and is capable of forming the uniform solid black image, irrespective of the curvature. According to this embodiment, the clearance difference ($g_2-g_1$) is not less than 0.25. If this is not less than 0.34, the effect of this embodiment is further significant, so that the size of the developing device can be reduced.

The following reason is considered. If the toner particle layer is formed on the sleeve 22, and simultaneously, some other toner particles are retained on the surface of the magnetic particles, and therefore, the amount of the toner reciprocable by the alternating electric field is increased, this means that the number of developing actions is increased and that the developable region is increased. Furthermore, the magnetic particles function as if they are the opposite electrode which is very close or contacted to the photosensitive member 1. Therefore, it is difficult that the edge effect by the electric field occurs.

The description will be made with respect to the blade 24 of non-magnetic material.

EXAMPLE 1

A developing apparatus was constructed according to this embodiment, as shown in FIG. 1. As for the sleeve 22, an aluminum sleeve having the diameter of 18 mm was used after the surface thereof was treated by irregular sandblasting with ALUNDUM abrasive. Within the sleeve 22, the magnet 23 magnetized with four poles was used, the N and S poles being arranged alternately along the circumference as shown in FIG. 1. The maximum surface magnetic flux density by the magnet 23 was approximately 900 Gauss.

The blade 24 used had the thickness of 1.2 mm made of non-magnetic stainless steel. The angle θ was set 15 degrees.

As for the magnetic particles, ferrite particles (maximum magnetization of 60 emu/g) had the particle size of 70–50 microns (250/300 mesh), whose surface was treated by silicon resin.

As for the non-magnetic toner, black powder provided by a mixture of 100 parts of styrene/butadiene copolymer resin and 5 parts of carbon black, and added by 0.6% of the colloidal silica, was used. The average particle size of the toner particles was 10 microns. Upon operation, approximately 20–30 microns thickness of the toner layer was obtained on the sleeve 22 surface, and above the toner layer, the magnetic particle layer of 100–200 microns thickness was formed. On the surfaces of the magnetic particles, there were toner particles.

At that time, the total weight of the magnetic particles and the toner particles on the sleeve 22 was approximately $2.43\times10^{-2}$ g/cm$^2$.

The magnetic particles were formed into erected chains at and adjacent the developing position by the magnetic pole **23*b* within the sleeve 22**. The maximum height of the chains was approximately 0.9 mm.

The amount of electric charge was measured by a blow-off method, and the triboelectric charge of the toner particles on the sleeve 22 and the magnetic particles was +10 mC/g.

The developing apparatus was assembled into a commercial copying machine, PC-10 sold by Canon Kabushiki Kaisha, Japan with a modification to provide the drum peripheral speed of 200 mm/sec (process speed). The clearance between the surface of the photosensitive drum 3 made of organic photoconductor material and having the diameter of 60 mm, and the surface of the sleeve 22 was set 350 microns. The clearance difference ($g_2-g_1$) was 0.30 mm. The volumetric ratio under those conditions was approximately 10% (h=350 microns, M=$2.43\times10^{-2}$ g/cm$^2$. 5.5 g/cm$^3$ C/(T+C)=20.4%) The bias voltage source 34 provided an alternating voltage having the frequency of 1600 Hz, wherein an alternating voltage having the peak-to-peak value of 1300 V was superimposed with a DC voltage of −300 V. When this was operated, good images were obtained.

The developing operation was performed to obtain a solid black image, and then the surface of the sleeve 22 was carefully observed after the developing operation. It was confirmed that almost all of the toner particles on the sleeve and on the magnetic particles were consumed up, and therefore, the developing operation was effected with almost 100% development efficiency.

It was confirmed that the development properties were good enough without foggy background. The solid black image was developed as a uniform image without a local void and having a high image density (1.39), and the V-D curve was as indicated by the reference $X_2$ in FIG. 7.

Comparison Example 1

The blade 26 was removed from the developing apparatus shown in FIG. 1, and a one component magnetic toner particles for NP-150Z (sold by Canon Kabushiki Kaisha, Japan) was used. The developing operation was performed in the similar manner as in the foregoing embodiment. The image was fairly good, but the edge effect was strong by which the internal part of the solid image was slightly light. The density of the solid black image was 1.15 which was not completely satisfactory.

EXAMPLE 2

The apparatus described before in the Comparison Example 1 was modified by assembling the same into a copying machine having a photosensitive drum of 30 mm diameter and having the process speed of 200 mm/sec. The clearance between the photosensitive drum 3 and the surface of the sleeve 22 was set 350 microns. The clearance difference was 0.36 mm. The bias voltage 34 was such as to provide an alternating voltage of 1600 Hz, the combination of an alternating voltage of 1300 V peak-to-peak voltage and −300 V DC voltage. The resultant image was good.

When a solid black image was developed, and the sleeve surface after the development was observed, it was confirmed that the toner on the sleeve and the toner on the magnetic particles were almost all consumed up, namely, the development efficiency was almost 100%.

The developing property was also good without foggy background, and the solid black image was substantially free from the local void, and uniform. The image density was sufficiently high, 1.37. The development property was as shown in FIG. 3 by the reference X2.

Comparison Example 2

The experiment was carried out in the similar conditions to the Example 2 with the exception that the developing apparatus and the developer of the Comparison Example 1 were used. A fairly good image was obtained, but the solid black image was not sufficient because of the local void (the leading edge of the image was a little light as compared with the trailing edge of the image). The image density was 1.03 which was not satisfactory.

As regards the developing property, it was like the curve Y2 as shown in FIG. 7. Since it is less steep in the low potential portion, the background fog tends to occur, while the image density is slightly low at the high potential portion. Even if the curvature of the developing position is not so large, the V-D curve in the case of the above developing method using the thin layer of one component magnetic developer (e.g. U.S. Pat. Nos. 4,395,476), becomes less steep (the foggy background tends to occur) in the low potential portion as in the case where the curvature increases, if the process speed is increased. And, the image density at the high potential portion is a little low. In the apparatus of the present invention, however, the V-D curve does not significantly change even if the process speed is increased. This is similar to the case where the curvature increases. Thus, the foggy background does not occur in the low potential portion, and the proper inclination is maintained in the middle potential region, and still in the high potential region, a sufficiently high image density can be provided. This is remarkable when the process speed is 150–400 mm/sec.

As described, according to this embodiment, the developing operation is possible with high image density, high development efficiency and without foggy background, ghost image, trace of brushing or the negative property.

Particularly, when the curvature is large in the developing position, a high image quality not having been obtained by conventional developing method can be obtained when the process speed is high.

In the embodiment of FIG. 8, the preferable conditions described hereinbefore are satisfied. More particularly, the volumetric ratio of the magnetic particles at the developing station is 1.5–30% (more preferably 2.6–26%); the angle θ between the blade 24 and the magnetic pole 23*a* is 2–40 degrees (more preferably 5–20 degrees); the weight ratio of the toner particles retained on the surfaces of the magnetic particles to the toner particles retained on the surface of the sleeve is 1:2–10:1 (more preferably, 1:1–5:1; and the amount of the developer (magnetic particles plus toner particles) is $0.5\times10^{-2}$ g/cm$^2$.

The present invention includes any combination of the above described preferable conditions.

Referring back to FIG. 6, the line L1 is the line connecting the center of the magnetic pole 23*a* disposed upstream of the blade 24 with respect to the movement of the surface of the sleeve 22 and the rotational center of the sleeve 22. The line L1 defines the angle θ. In the example of FIG. 6, on an extension of the line L1, there is a surface of the limiting member 26 opposed to the sleeve 22, and the magnetic pole forms a most condensed portion of the magnetic particles. The length of the surface measured along the peripheral movement of the sleeve 22 is 10 mm. As will be understood from FIG. 6, the volumetric ratio of the magnetic particles at the developing position is smaller than the volumetric ratio of the magnetic particles in this most condensed portion.

As regards the magnetic pole 23*b* at the developing position, it is disposed at the center of the developing station in the direction of the movement of the surfaces of the photosensitive member and the sleeve. However, it may be deviated from the center, or the developing position may be disposed between magnetic poles.

To the toner powder, silica particles may be added to enhance the flowability or abrasive particles or the like may be added to abrade the surface of the photosensitive drum 1 (latent image bearing member) in an image transfer type image forming apparatus. To the toner powder a small amount of magnetic particles may be added. Magnetic toner particles may be used if the magnetic property thereof is very weak as compared with that of the magnetic particles and is triboelectrically chargeable.

In order to prevent the occurrence of the ghost image, the developer layer remaining on the sleeve 22 after the developing action may. be once scraped off by scraper means (not shown), and then the scraped sleeve surface is brought into contact to the magnetic particle layer in the container, and then the developer is applied thereon. This is effective to prevent the ghost image.

A mechanism may be added to the developing apparatus, which detect the content of the magnetic particles and the toner particles, and in response to the detection, the toner is automatically supplied.

The developing apparatus according to the present invention is usable with a disposable developing device which contains as a unit the container 21, the sleeve 22 and the blade 24, although it is applicable to the usual developing device which is fixed in an image forming apparatus.

A further aspect of the present invention will be described.

Figure 9:
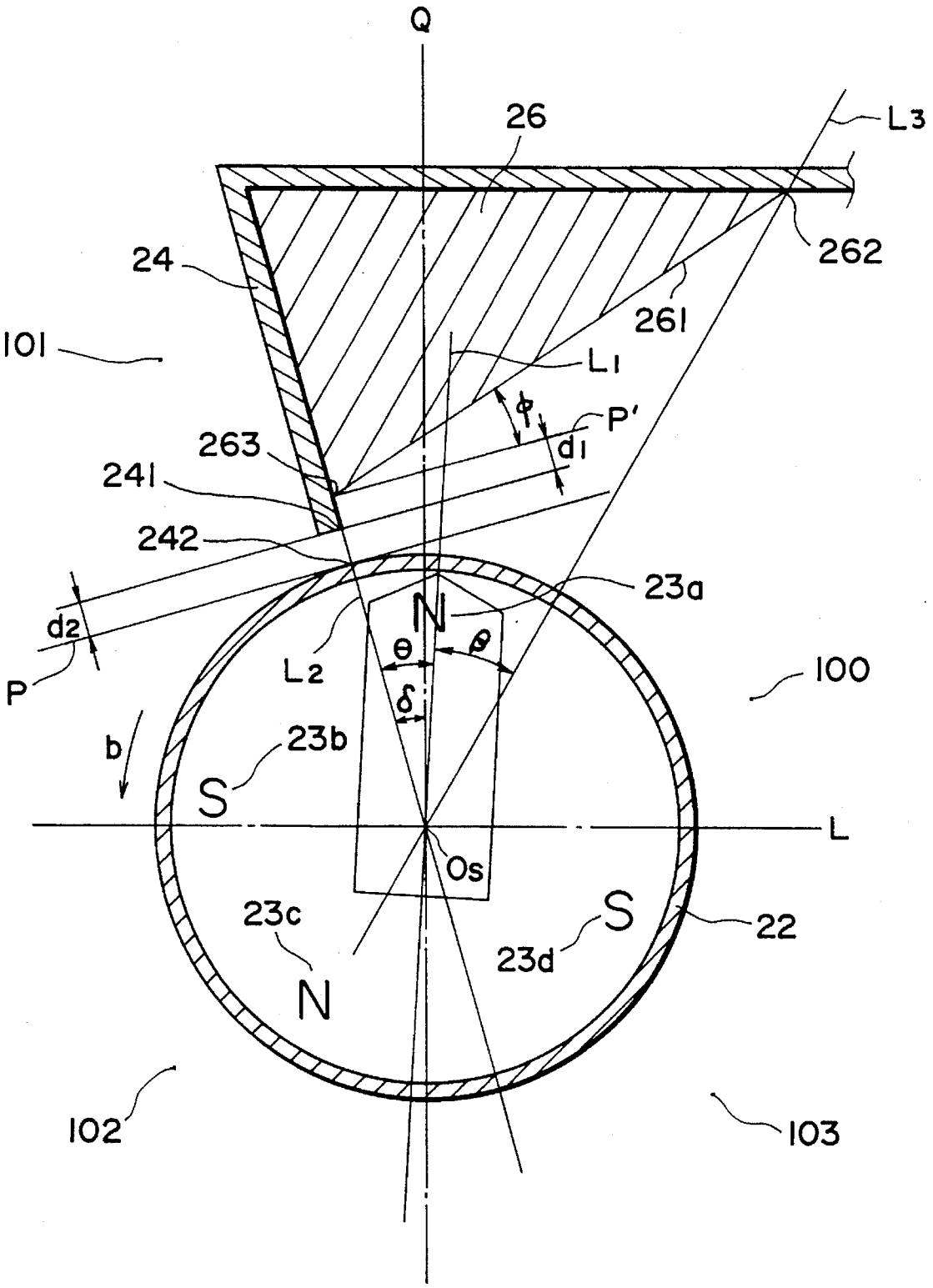
FIG. 9 is an enlarged sectional view illustrating the positional relationship between a developer circulation limiting member and an associated magnet.
Figure 10:
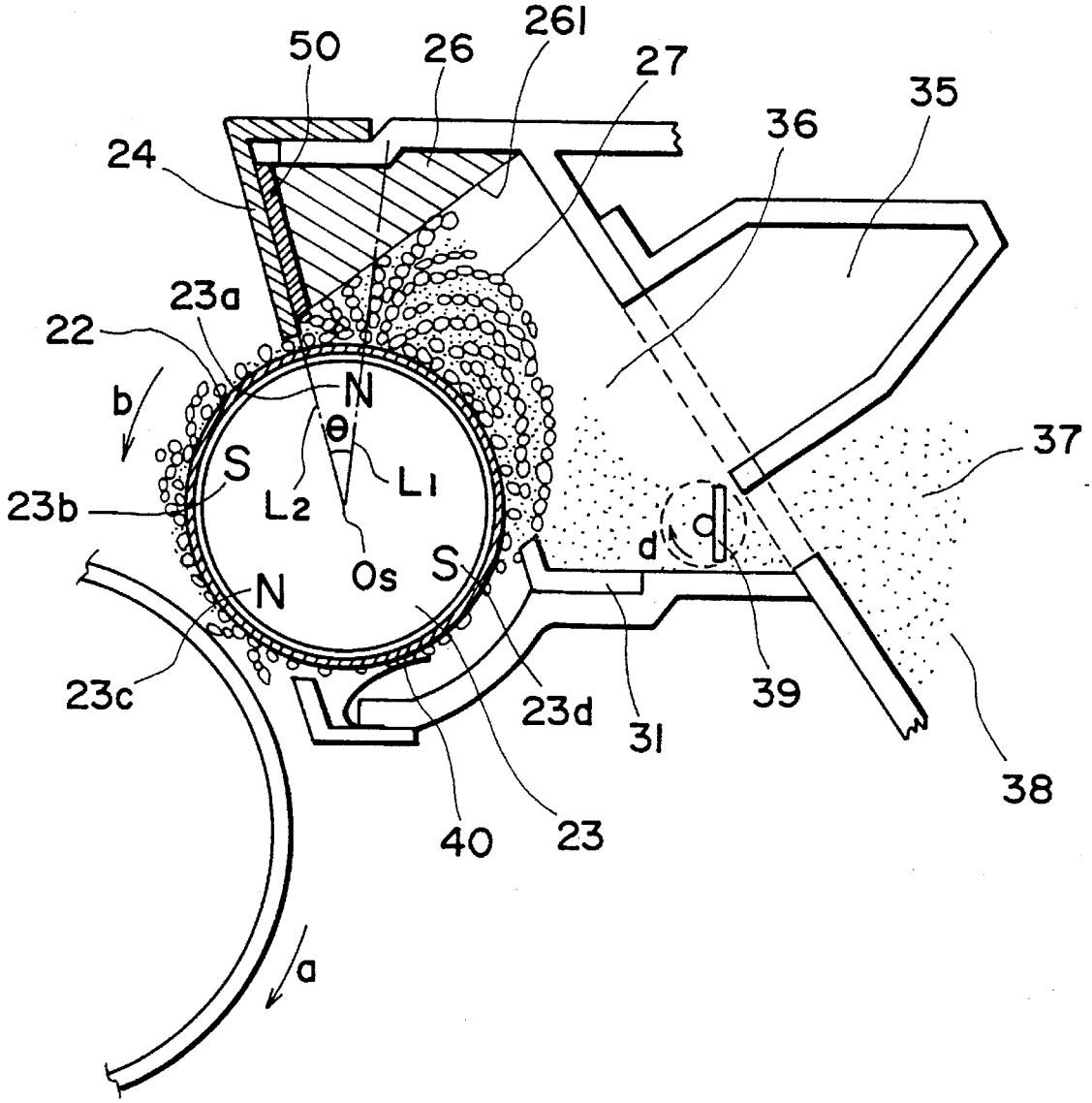
FIG. 10 is a sectional view of a modification of the embodiment of FIG. 9.

Referring to FIGS. 9 and 10, a detailed description will be made with respect to the structure adjacent the developer outlet portion of the developer container 24, more particularly with respect to the relationship between the magnetic pole 23*a* and the developer guiding surface 261 of the developer circulation limiting member 26. FIG. 9 illustrates the developer outlet portion in the state when the developing device is assembled into a copying machine, wherein a horizontal plane including the central axis Os of the developing sleeve 22 is designated by a reference L, and the vertical plane including the central axis Os is indicated by a reference Q. In the coordinates defined by the plane L and the plane Q, the first, second, third and fourth quadrants are designated by reference numerals 100, 101, 102 and 103. The regulating member 24 has a regulating edge 241 which is spaced by a smallest distance $d_2$ from a portion 242 of the developer sleeve 22 surface which is opposed to the regulating edge 241. The regulating member 24 is fixed to the container 24. The developer guiding surface 261 of the limiting member 26 forms a clearance with the surface of the sleeve 22. The guiding surface 261 is inclined such that the clearance gradually decreases from the upstream side 262 to the regulating member side end 263 with respect to movement of the surface of the sleeve 22. The end 263 is contacted to the regulating member 24, where the developer is regulated by the edge 241 of the regulating member 24. The end 263 of the guiding surface is spaced from the surface of the sleeve 22 by $(d_1+d_2)$, wherein $d_1$ is a distance from the end 263 and the end 241. The distance $d_1$ is larger than 0. A plane P' is considered which is parallel to a plane P and which is tangential to the surface of the sleeve 22 at the opposing position 242 and which includes the end 263. The angle ρ formed between the guiding surface 261 and the plane P' has been found important as a parameter influential to the developer guiding effect and the developer circulating effect. In this Figure, a reference L1 is a line on the sectional view of this Figure, extending through the center of the sleeve Os and the maximum magnetic flux density position of the magnetic pole 23*a*; L2, a line extending through the center Os of the sleeve 22 and the edge 241 of the regulating member 24; and θ, the angle formed between the line L1 and the line L2. It has also been found that the angle θ is also important as a parameter influential to the action in the developer regulating zone. An angle β (>0) is formed between the line L1 and a line L3 which connects the center Os of the sleeve 22 and the end 262 of the guiding surface 261. An angle δ is formed between the line L2 and the vertical plane Q. In this embodiment, the regulating member 24 is made of non-magnetic material. The toner is of non-magnetic toning particles, and the carrier is magnetic particles which are ferrite particles coated by a resin. The resistance of the carrier particle is not less than $10^7$ ohm.cm.

The distance $d_2$ between the sleeve surface and the end 241 of the non-.magnetic regulating blade 24 is 50–600 microns, preferably 150–500 microns. If the clearance $d_2$ is smaller than 50 microns, the clearance is easily clogged with the magnetic particles, resulting in the formation of non-uniform developer layer and also in the defficiency of the amount of the developer in the developer layer, whereby the developed image is not uniform and with an insufficient image density. If, on the other hand, it is larger than 600 microns, the amount of the developer applied on the sleeve 22 is too much, so that the regulating function is not sufficient. Then, an increased amount of the magnetic particles is transferred onto the latent image bearing member. Additionally, the circulation of the developer which will be described in detail hereinafter becomes insufficient with the decreased developer limiting function of the developer circulation limiting member 26, and with insufficient triboelectric charge to the toner particles, leading to the foggy background. The distance $d_1$ between the non-magnetic blade edge 242 and the guiding surface end 263 is 0.5–5.0 mm, preferably 1.5–4.0 mm. If the clearance $d_1$ is smaller than 0.5 mm, the pressure exerted by the limiting member 26 to the developer to the developing sleeve 22 is increased, the triboelectric charge to the developer is extremely increased so that a desired developing property is not assured. If the toner is of a pressure fixing type, the toner is liable to be fused and fixed to the surface of the sleeve 22.

If this is larger than 5.0 mm, the pressure is too small with the result of insufficient triboelectric charge to the toner. However, it is possible that the distance $d_1$ is set larger than 5.0 mm if the developing apparatus is equipped with an automatic toner supplying mechanism as in the usual developing apparatus using two component developer and if the sufficient triboelectric charging has been accomplished beforehand between the carrier particles and toner particles. The sum of the distances $d_1$ and $d_2$ is not more than 5.6 mm, more preferably not more than 5 mm.

The angle ϕ, which is positive when measured from the plane P' to the upside, is preferably more than 0 degree but not more than 45 degrees, more preferably more than 0 and not more than 30 degrees. If the angle is not more than 0 degree, the space defined by the guiding surface 261, the edge 241 of the blade 24 and the developing sleeve 22 is in the form of a sharp wedge, so that the space is clogged with the developer with the result that the increased pressure is produced which leads to an extremely high triboelectric charge of the toner, and that the toner is fused and fixed. If the angle is larger than 45 degrees, the pressure exerted to the developer by the limiting member 26 toward the developing sleeve 22 is insufficient so that the intended function of the limiting member 26 is not expected.

The angle θ is 0–35 degrees, preferably 5–25 degrees. If the angle is less than 0 degree, the thin developer layer formed by the cooperation among the magnetic force, the image force and the agglomerating force to the developer, is non-uniform, and the amount of the developer in the layer is insufficient. If the angle θ is larger than 35 degrees, the amount of the developer in the developer layer is increased when the blade is of non-magnetic material, so that it is difficult to provide a desired amount of the developer in the layer. The angle δ, which is positive when measured in the clockwise direction from the vertical plane Q in the Figure satisfies preferably $-60<\delta<+120$ degrees.

In the quadrants as defined in FIG. 9, the limiting member 26 is disposed above the horizontal plane L including the rotational axis of the sleeve 22, and the developer guiding surface 261 extends across the vertical plane Q including the rotational axis Os, that is, the guiding surface 261 exists in the second quadrant 101 and the first quadrant 100. Because of this arrangement, in addition to the function of the guiding surface 261 that the developer is stably supplied to the developer regulating zone, the gravity is effectively utilized to supply the developer into this zone more stably.

The regulating edge 241 of the regulating member 24 is disposed in the second quadrant 101 defined by the horizontal plane L and the vertical plane Q and is spaced apart from the surface of the sleeve 22. Due to this arrangement, the regulating edge 241 is downstream of the vertical plane Q with respect to the direction b of the movement of the sleeve 22, and the magnetic particles are concentrated in the space adjacent the regulating edge 241 in the container, and furthermore, a space mainly occupied by the magnetic particles is stably formed.

A developing apparatus was constructed, wherein $d_1$=1.5 mm, $d_2$=250 microns, θ=18 degrees, δ=15 degrees, ρ=20 degrees.

The apparatus had the developing zone in the third quadrant 102 and the sealing zone in the fourth quadrant 103 as shown in FIG. 10. In the container, a magnetic particle layer was formed on the surface of the sleeve 22, and a toner particle layer was formed on the magnetic particle layer, and the developing operation was carried out.

The following has been confirmed. In the magnetic particle layer, the movement of the magnetic particles caused by the sleeve 22 rotation becomes slow with the distance from the surface of the sleeve 22, due to the balance among the magnetic force, the confining force by the gravity and the conveying force by the sleeve 22 movement. In the upper portion (away from the surface of the sleeve 22), the magnetic particles are stationary although slightly movable, to constitute a stationary layer. Some of the magnetic particles in this layer fall due to the gravity.

Adjacent the surface of the sleeve 22, a movable layer of the magnetic particles is formed, wherein the magnetic particles are moved toward the magnetic pole 23*a*. The movement is provided by suitable positioning of the magnetic poles 23*a* and 23*d*, the flowability and the magnetic properties of the magnetic particles.

The movement in the magnetic particle layer depends on the flowability of the developer and the magnetic force. More particularly, when the toner contents in the magnetic powder is low, the size of the stationary layer is decreased, so that most of the magnetic particle layer moves at a relatively high speed to take the toner particles into the magnetic powder from the toner layer. When the toner content is high, on the other hand, the size of the stationary layer is increased, the movable layer in the magnetic particle layer is covered by the stationary layer so that the movable layer is prevented from direct contact with the toner layer, and therefore, the toner is not taken into the magnetic powder in the movable layer thus, the toner content in the movable layer is naturally maintained without specific control mechanism.

Next, the description will be made with respect to the magnetic particle layer adjacent the non-magnetic blade 24 and the circulation limiting member 26.

The limiting member 26 mechanically limits or prevents the entering of the developer toward the regulating zone. In addition, the regulating zone defined by the limiting member 26 and the sleeve 22 is physically charged by the magnetic particles conveyed by the magnetic pole and the sleeve rotation, by the function of the guiding surface 261 of the limiting member 26. Because of this charging, the density of the magnetic powder is relatively high. In this zone, there are on-coming magnetic particles and out-going magnetic particles, so that the magnetic particles are stirred and hit each other under the relatively packed state. Therefore, the triboelectric charge to the toner is positively performed by the contact with the sleeve surface and the magnetic particles. In addition, the toner particles which are not sufficiently charged and carried on the sleeve 22 and on the magnetic particles to this zone are released from the sleeve 22 and the magnetic particles. Thus, the selection of the sufficiently charged toner particles is effected, and also the charging to the toner is improved. In this manner, only the toner particles which are triboelectrically charged to a sufficient extent can be conveyed to the developing position. The non-uniform state under which the magnetic particles are carried on the sleeve is also removed in this zone, and therefore, the magnetic particle layer is effectively made uniform and stabilized.

As described above, the guiding surface 261 of the limiting member 26 is very important, and therefore, the inclination of the guiding surface 261 and the volume of the zone is influential to the state of the magnetic particles packed in the zone.

The magnetic pole 23*a* disposed opposed to this zone is effective to impart moving force along the magnetic lines of force to the magnetic particles packed in the manner described above. The packed state is not completely stable with respect to the triboelectric charging, and therefore, it is desirable from the standpoint of the stabilization to establish a constant state of packing. The magnetic pole 23*a* is effective to do this. The magnetic particles conveyed on the surface of the sleeve 22 in the direction tangential thereto are formed into a magnetic brush by the magnetic force perpendicular to the tangential direction, and therefore, the magnetic particles are stirred and particulated. For this reason, the triboelectric charging to the toner particles are stabilized with the uniform and stabilized formation of the magnetic particle layer. A problem is possible that the developer is too much packed, when the developer concentrated by the peripheral structures is kept receiving large pressure. Since, however, the maximum magnetic force portion of the magnetic pole 23*a* is opposed to the guiding surface 261, the extreme pressure concentration in the regulating zone is prevented, and therefore, the desirable concentration the developer and the stabilized high density magnetic powder can be maintained.

The arrangement of the magnetic particle 23*a* is effective particularly when the magnetic particles are relatively easily packed in the regulating zone, for example, when the angle δ shown in FIG. 9 is smaller than 0.

By the regulating zone described above, the thin developer layer comprising the stabilized amount of the magnetic particles and the sufficiently charged toner particles, is formed on the surface of the developing sleeve 22. Therefore, the developing action in the developing position 102 is stabilized. In the developing zone, there is formed an alternating electric field which is effective to transfer at least the toner particles from the developer carried thereto on the sleeve, to the latent image bearing member. It has been confirmed that the above described arrangement in the regulating zone is particularly effective in the developing apparatus described hereinbefore, that is, the developing apparatus wherein the volumetric ratio of the magnetic particles in the developing zone is 1.5–30%.

Referring to FIG. 10, a magnetic member 31 is disposed opposed to the developing sleeve 22 adjacent the inside bottom of the developer container to prevent the magnetic particles 27 and the non-magnetic toner particles 37 from leaking out of the container 36 adjacent the bottom thereof. The magnetic member 31 is a plated iron plate, for example. A sealing effect is provided by the magnetic field formed between the magnetic pole 23*d* (S) and the magnetic member 31. A toner supplying member 39 functions to supply the toner particles to the brush of the magnetic particles formed by the fixed magnetic pole 23 in the sleeve 22. The toner supplying member 39 has a rotatably supported metal sheet coated by a rubber sheet. It rotates and sweeps the bottom surface of the container 36, thus transporting the toner. To the toner supplying member 39, the toner is supplied by a supplying member (not shown) in the toner container 38. The magnetic particles are contained in a magnetic particle container 35.

A sealing member 40 is provided adjacent the bottom portion of the developer container 36 to prevent the toner particles in the bottom portion from scattering around. The sealing member is of an elastic material and bent in the direction of rotation of the sleeve 22, and is resiliently urged to the surface of the sleeve 22.

The sealing member 40 has an end at the downstream side with respect to rotation of the sleeve 22, in the contact area with the sleeve 22 so as to allow the developer to enter the container 36 with the rotation of the sleeve.

In FIG. 10, a magnetic member 50 is disposed in the non-magnetic blade side of the circulation limiting member 26. It is not preferable to dispose the magnetic member 50 at a position opposed right to the magnetic pole 23*a*, since then the magnetic field concentrates between the magnetic pole 23*a* and the magnetic member 50, resulting in that the stirring and particulating functions of the magnetic pole 23 are decreased. When, however, it is effective to use the magnetic member 50 in the regulating zone to magnetically regulate the magnetic particles by the cooperation thereof with the magnet 23 in the sleeve 22, since the tolerance to the clearance between the regulating member and the surface of the sleeve 22 can be increased.

Further, it has been found that the amount of the charge applied to the toner particle retained on the sleeve 22 is smaller than that of the toner particle retained on the magnetic particle. The reason for this is considered as being that the magnetic particles are also conveyed by the rotation of the sleeve 22, the opportunities of the toner particles on the sleeve 22 being frictioned with the magnetic particles are not sufficient. It is preferable to increase the charge level of the toner particle to a desirable level.

If, in an attempt to accomplish this, the conveying power of the magnetic particles is simply reduced, no desirable performance can be obtained because of unsatisfactory taking of the toner particles into the magnetic powder. If, on the other hand, a magnetic member is disposed opposed right to the magnetic pole 23*a* to create a concentrated magnetic field to increase the friction of the magnetic particles to the sleeve 22, the effects which are provided by disposing the maximum magnetic force portion of the magnetic pole 23*a* to the space formed by the limiting member 26 are reduced.

In this embodiment, the magnetic member 50 is disposed downstream of the magnetic pole 23*a* with respect to the movement of the surface of the sleeve 22 such that the magnetic lines of force by the magnetic pole 23*a* at the blade side are concentrated in substantially the tangential direction. The formation of such magnetic force retards the movement of the magnetic particles on the sleeve 22, thus increasing the density of the magnetic powder. Then, the contacts and sliding of the toner particles with respect to the magnetic particles are activated. In addition, only the magnetic particles in the neighborhood of the surface of the sleeve 22 are formed into a magnetic brush extending substantially along the surface of the sleeve 22, so that the toner particles on the sleeve 22 are frictioned, with the result that the toner particles on the sleeve 22 are more charged triboelectrically.

The length of the guiding surface 261 between the edge 263 and the edge 262 is preferably not less than 5 mm and not more than 15 mm when measured along the movement of the surface of the sleeve 22, the surface 261 being flat. If it is less than 5 mm, the developer guiding effect is decreased very much, so that the magnetic particles can move above the limiting member 26. The length more than 15 mm is not preferable from the standpoint of decreasing the size of the apparatus.

The angle β formed between the line L1 and the line L3 is preferably not less than 5 degrees. This is preferable in order that the magnetic field provided by the magnetic pole 23*a* in the regulating zone defined by the angle (θ+β) is effective together with the regulating member 24 and the guiding surface 261 (the magnetic member 50).

The magnetic flux density by the magnetic pole 23*a* is not less than 600 Gausses, preferably not less than 700 Gausses. This is because the state of application of the developer which can be changed depending on the toner content in the magnetic particle layer is more stabilized with the increase in the magnetic flux density of the magnetic pole 23*a*. Particularly when an automatic toner supplying mechanism for maintaining the toner content is not employed as in the embodiment, the magnetic flux density by the magnetic pole 23*a* is preferably not less than 800 Gausses.

In FIG. 10, the magnetic pole 23*c* which is a developing pole produces, preferably, not less than 800 Gausses of the magnetic flux density in order to prevent the magnetic particles from being deposited onto the latent image. Also, the developing magnetic pole 23*c* is opposed substantially right to the developing position.

A conveying magnetic pole 23*b* (S) serves to prevent the developer layer uniformly applied by the non-magnetic blade from being disturbed when the distance between the magnetic pole 23*a* and the developing magnetic pole 23*c* are spaced by a relatively large distance. The strength of the magnetic pole 23*b* is preferably equivalent or slightly lower than that of the developing electrode 23*c* in order to prevent the disturbance to the layer of the developer. When the diameter of the developing sleeve 22 is 20 mm, the disturbance of the developer layer is not significant if the angle formed between the magnetic pole 23*a* and the developing magnetic pole 23*c* is not more than 100 degrees as seen from the center of the sleeve 22. If however, the arrangement is such that the angle is more than 100 degrees, the disturbance is so significant that the in between magnetic pole is employed.

A magnetic pole 23*a* (S) is used to collect the developer after the development. The magnetic pole 23*d* is disposed upstream of the edge of the magnetic seal with respect to the movement of the developing sleeve 22. If the magnetic pole 23*d* is disposed downstream of the edge of the magnetic seal, the magnetic particles are formed into a brush by the magnetic pole 23*d* in the neighborhood of the inlet portion of the developer container 36 where the developer not consumed for the development enters the container 36. Because of this, the toner is very easily taken into the magnetic powder, with the result that the toner particles are not sufficiently triboelectrically charged so that a foggy background is produced.

The present invention includes any combination of the structures described above, as will be readily understood from the explanation.

As described above, according to the present invention, the high quality image can be produced, and the developing apparatus is particularly suitable for a small size disposable developing apparatus.

While the invention has been described with reference to the structures disclosed herein, it is not confined to the details set forth and this application is intended to cover such modifications or changes as may come within the purposes of the improvements or the scope of the following claims.

What is claimed is:

1. A developing method comprising the steps of:

disposing a developer carrying member having a surface carrying a developer containing toner particles and magnetic particles opposite an image bearing member bearing an electrostatic image, whereby the magnetic particles are formed into chains, and toner particles are carried on both the chains and the surface of the developer carrying member;

contacting the chains to the image bearing member; and generating an alternating electric field between the image bearing member and the developer carrying member, for moving toner particles from the surface of the developer carrying member to the image bearing member.

2. A method according to claim 1, including the step of developing the electrostatic image by both toner particles on the surface of the developer carrying member and toner particles carried by the chains of magnetic particles.

3. A method according to claim 1, wherein the toner particles are non-magnetic.

4. A method according to claim 1, wherein toner particles carried on said developer carrying member are present in an amount not less than $0.05\times10^{-3}$ g/cm$^2$ and not more than $1.0\times10^{-3}$ g/cm$^2$.

5. A method according to claim 1, including the step of forming toner particles on said developer carrying member into a layer having a thickness which is 1/50–1/5 of a gap formed between said developer carrying member and said image bearing member.

6. A method according to claim 1, wherein a weight ratio between the toner particles retained on the chains of magnetic particles and the toner particles retained on the developer carrying member is 1:2–10:1.

7. A method according to claim 6, wherein the weight ratio is 1:1–5:1.

8. A method according to claim 1, wherein trace formation on a developed image due to brushing contact by the chains is prevented.

* * * * *

UNITED STATES PATENT AND TRADEMARK OFFICE

CERTIFICATE OF CORRECTION

PATENT NO. : 5,574,545 Page 1 of 3

DATED : November 12, 1996

INVENTOR(S) : ATSUSHI HOSOI, ET AL.

It is certified that error appears in the above-indentified patent and that said Letters Patent is hereby corrected as shown below:

ON THE COVER PAGE:

[21] APPLICATION NO.:

"455,716" should read --445,716--.

COLUMN 3:

Line 9, "efficiently" should read --efficiently.--.

COLUMN 12:

Line 49, "Since then," should read --Since--.

COLUMN 13:

Line 41, "set" should read --set at--.

UNITED STATES PATENT AND TRADEMARK OFFICE

CERTIFICATE OF CORRECTION

PATENT NO. : 5,574,545

DATED : November 12, 1996

INVENTOR(S) : ATSUSHI HOSOI, ET AL.

It is certified that error appears in the above-indentified patent and that said Letters Patent is hereby corrected as shown below:

COLUMN 14:

Line 36, "into-three" should read --into three--.

COLUMN 16:

Line 4, "development" should read --developments--.
Line 16, "can not" should read --cannot--.

COLUMN 17:

Line 66, "produced" should read --produced.--.

COLUMN 18:

Line 67, "made" should be deleted.

COLUMN 22:

Line 30, "set" should read --set at--.
Line 33, "$g/cm^2.5\cdot5$" should read --$g/cm^2$, $p=5\cdot5$--.
Line 34, "$g/cm^3$ $C/(T+C)=20\cdot4\%$)" should --$g/cm^3$, $C/(T+C)=20\cdot4\%$).--.

UNITED STATES PATENT AND TRADEMARK OFFICE

CERTIFICATE OF CORRECTION

PATENT NO. : 5,574,545

DATED : November 12, 1996

INVENTOR(S) : ATSUSHI HOSOI, ET AL.

It is certified that error appears in the above-indentified patent and that said Letters Patent is hereby corrected as shown below:

COLUMN 24:

Line 37, "may." should read --may--.
Line 43, "detect" should read --detects--.

COLUMN 28:

Line 18, "concentration" should read --concentration of--.

COLUMN 30:

Line 25, "in between" should read --inbetween--.

Signed and Sealed this

Eighth Day of July, 1997

Bruce Lehman

*Attest:*

BRUCE LEHMAN

*Attesting Officer*

*Commissioner of Patents and Trademarks*